US008298734B2

(12) United States Patent
Shimada et al.

(10) Patent No.: US 8,298,734 B2
(45) Date of Patent: Oct. 30, 2012

(54) ELECTROPHOTOGRAPHIC PHOTORECEPTOR, IMAGE FORMING METHOD, IMAGE FORMING APPARATUS, AND PROCESS CARTRIDGE

(75) Inventors: Tomoyuki Shimada, Numazu (JP); Naohiro Toda, Yokohama (JP); Yoshinori Inaba, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 530 days.

(21) Appl. No.: 12/590,432

(22) Filed: Nov. 6, 2009

(65) Prior Publication Data

US 2010/0119964 A1 May 13, 2010

(30) Foreign Application Priority Data

Nov. 10, 2008 (JP) ..... 2008-287851

(51) Int. Cl.
*G03G 13/16* (2006.01)
*G03G 21/18* (2006.01)

(52) U.S. Cl. ..... 430/58.35; 430/120.1; 399/111; 399/119; 399/297

(58) Field of Classification Search ..... 430/58.35, 430/120.1; 399/111, 119, 297
See application file for complete search history.

(56) References Cited

U.S. PATENT DOCUMENTS

| | | | |
|---|---|---|---|
| 3,816,118 A | 6/1974 | Byrne | |
| 3,954,568 A | 5/1976 | DuPree | |
| 5,338,634 A * | 8/1994 | Ueda | 430/58.75 |

FOREIGN PATENT DOCUMENTS

| | | |
|---|---|---|
| JP | 52-36016 | 9/1977 |
| JP | 53-095033 | 8/1978 |
| JP | 53-132347 | 11/1978 |
| JP | 53-133445 | 11/1978 |
| JP | 54-002129 | 1/1979 |
| JP | 54-012742 | 1/1979 |
| JP | 54-014967 | 2/1979 |
| JP | 54-017733 | 2/1979 |
| JP | 54-021728 | 2/1979 |
| JP | 54-022834 | 2/1979 |
| JP | 60-196768 | 10/1985 |
| JP | 64-017066 | 1/1989 |
| JP | 03-096961 | 4/1991 |
| JP | 11-021466 | 1/1999 |
| JP | 2000-231204 | 8/2000 |
| JP | 2004-258253 | 9/2004 |

OTHER PUBLICATIONS

A. Itami et al., "The Effects of Nitrogen Oxide on the Resolution of Organic Photoconductors," Konica Technical Report, vol. 13 (2000), pp. 37-40.

E. Elce et al., "A new synthesis of bisbenzils and novel poly(penylquinoxalines) therefrom," Polymer, vol. 37, No. 9 (1996), pp. 1745-1749.

Iijima et al., "(1B4 04) New Polymorphs of Chlorogallium Phthalocyanine and Their Photogenerating Properties," 67th Annual Meeting, Chem. Soc'y of Japan, 1994 (abstract).

Daimon et al., "(1B4 05) A New Polymorph of Hydroxy Gallium Phthalocyanine and its application for Photoreceptor," 67th Annual Meeting, Chem. Soc'y of Japan, 1994 (abstract).

* cited by examiner

*Primary Examiner* — Hoa V Le
(74) *Attorney, Agent, or Firm* — Cooper & Dunham LLP

(57) ABSTRACT

An electrophotographic photoreceptor including a conductive substrate and a photosensitive layer located overlying the conductive substrate. The photosensitive layer comprises a specific diamine compound.

16 Claims, 5 Drawing Sheets

ELECTROPHOTOGRAPHIC PHOTORECEPTOR, IMAGE FORMING METHOD, IMAGE FORMING APPARATUS, AND PROCESS CARTRIDGE

BACKGROUND OF THE INVENTION

1. Field of the Invention

The present invention relates to an electrophotographic photoreceptor. In addition, the present invention also relates to an image forming method, an image forming apparatus, and a process cartridge using the electrophotographic photoreceptor.

2. Discussion of the Related Art

Electrophotographic image processing system devices have drastically improved recently. In particular, laser printers and digital copiers, which convert information into digital signals and record it optically, have drastically improved their printing quality and reliability. These laser printers and digital copiers have been merged with high-speed printing technologies and applied to full-color printing technologies recently. Because of this situation, it is desirable that electrophotographic photoreceptors (hereinafter simply "photoreceptors") are capable of producing high quality images and highly durable.

Electrophotographic laser printers and digital copiers generally use organic photoreceptors, which comprise organic photosensitive materials, because of their low cost, high productivity, and nonpolluting property. Organic photoreceptors are broadly classified into single-layer photoreceptors and functionally-separated multilayer photoreceptors. The first organic photoreceptor having been put into practical use is a PVK-TNF charge-transfer-complex-type photoreceptor, which is one of the single-layer photoreceptors. In 1968, each of Hayashi and Regensburger independently invented a PVK/a-Se multilayer photoreceptor. In 1977 and 1978, Meltz and Schlosser, respectively, have invented a multilayer photoreceptor in which the photosensitive layer is comprised of organic materials only. More specifically, the photosensitive layer comprises an organic pigment dispersing layer and an organic low-molecular-weight polymer dispersing layer. The former is what is called a charge generation layer (CGL) that absorbs light to generate charge. The latter is what is called a charge transport layer (CTL) that injects and transports the charge generated in the CGL to neutralize surface charge. Such a multilayer photoreceptor may be called a functionally-separated multilayer photoreceptor. Functionally-separated multilayer photoreceptors have made drastic improvement in sensitivity and durability compared to single-layer photoreceptors. CGL and CTL include a charge generation material (CGM) and a charge transport material (CTM), respectively, which have different functions. Since CGM and CTM can be independently molecular-designed, CGM and CTM have wide ranges of choice for usable materials. For these reasons, functionally-separated multilayer photoreceptors have become the mainstream of organic photoreceptors.

A mechanism of forming electrostatic latent images in functionally-separated photoreceptors is considered as follows. A photoreceptor which has been charged is exposed to light. The light is transmitted by a charge transport layer and is absorbed by a charge generation material in a charge generation layer to generate charge. The charge generated in the charge generation layer is injected into the charge transport layer at the interface between the charge generation layer and the charge transport layer. The charge migrates through the charge transport layer due to an electric field to neutralize surface charge of the photoreceptor. As a result, an electrostatic latent image is formed on the photoreceptor.

Disadvantageously, photosensitive layers of organic photoreceptors are likely to be abraded in repeated use. Abrasion of photosensitive layers may accelerate deterioration of charged potential and photosensitivity of photoreceptors and the resultant, image density and quality. Therefore, organic photoreceptors have been improved to have better abrasion resistance. In accordance with recent speeding-up and downsizing of electrophotographic apparatuses, photoreceptors have been also downsized, i.e., the diameter of photoreceptors has been reduced. For this reason, organic photoreceptors have been improved to have much better abrasion resistance lately.

In order to improve abrasion resistance of photoreceptors, various approaches have been proposed. For example, lubricating or hardening photosensitive layers, including a filler in photosensitive layers, or using charge transport polymers instead of polymers in which low-molecular-weight charge transport materials are dispersed. However, even when abrasion of photosensitive layer is prevented by the above approaches, other problems may occur. For example, oxidizing substances such as ozone and NOx, which are produced in repeated use of photoreceptors depending on surrounding environmental conditions, may adsorb to the surface of photosensitive layers and reduce electric resistance thereof, causing image blurring. Conventional photoreceptors have avoided such a problem because oxidizing substances can be removed along with abrasion of photosensitive layers. By contrast, recent highly-durable photoreceptors cannot avoid the problem in the same way because photosensitive layers have been improved to have high abrasion resistance, as described above. In view of this situation, one proposed approach includes providing a heater to photoreceptors so that oxidizing substances are vaporized. This approach is against the recent trends to downsize apparatuses and to reduce electric power consumption. Another proposed approach includes including an antioxidant in photosensitive layers. Since typical antioxidants have no photoconductivity, this approach may cause deterioration of sensitivity and increase of residual potential of photoreceptors when the amount of antioxidants in photosensitive layer is too large.

Accordingly; highly-abrasion-resistant photoreceptors may produce side effects such as the occurrence of image blurring and deterioration of image resolution. It may be difficult for photoreceptors to have high durability and to produce high quality images simultaneously. In order to prevent image blurring, electric resistance is preferably as large as possible. By contrast, in order to prevent increase of residual potential, electric resistance is preferably as small as possible. Such a tradeoff makes it more difficult to realize high durability and high quality image simultaneously.

Japanese Patent Application Publication No. (hereinafter JP-A) 2000-231204 discloses an aromatic compound having a dialkylamino group as an acid scavenger. It is disclosed therein that the aromatic compound prevents the occurrence of image blurring which is caused by oxidizing gases even after a photoreceptor is repeatedly used. However, the aromatic compound has too low charge transport ability to respond to demands of highly-sensitive and high-speed photoreceptors.

JP-A 60-196768 and Japanese Patent No. 2884353 each disclose stilbene compounds having a dialkylamino group. A technical document "The Effects of Nitrogen Oxide on the Resolution of Organic Photoconductors (Itami et al, Konica technical Report Vol. 13 (2000) p. 37-40)" reports that the above stilbene compounds prevent the occurrence of image blurring which is caused by oxidizing gases. The stilbene compounds have a triarylamine structure, which serves as a charge transporting site. The triarylamine structure has a dialkylamino group, which is a substituent having a strong mesomeric effect (i.e., +M effect) on a resonance position. Therefore, the ionized potential of the stilbene compound is extremely small. In a case in which such a stilbene compound is used alone as a charge transport material in a photosensitive layer, the charge retention capability of the photosensitive layer may be extremely poor from the initial stage, or may degrade with time. For this reason, it is difficult to put the stilbene compounds into practical use. Even when the stilbene compound is used in combination with another charge transport material, the stilbene compound may disadvantageously serve as a hole trapping site because the ionized potential of the stilbene compound is considerably smaller than that of the other charge transport material. As a result, the resultant photoreceptor may have extremely low sensitivity and high residual potential.

SUMMARY OF THE INVENTION

Accordingly, exemplary embodiments of the present invention provide a highly-durable electrophotographic photoreceptor which produces high-quality and high-density images without causing image blurring for an extended period of time. Exemplary embodiments of the present invention also provide an image forming method, an image forming apparatus, and a process cartridge which realize speeding up and downsizing and which reliably produce high quality images for an extended period of time without frequent replacement of photoreceptor.

These and other features and advantages of the present invention, either individually or in combinations thereof, as hereinafter will become more readily apparent can be attained by exemplary embodiments described below.

One exemplary embodiment provides an electrophotographic photoreceptor including a conductive substrate and a photosensitive layer located overlying the conductive substrate. The photosensitive layer includes a diamine compound having the following formula (1):

(1)

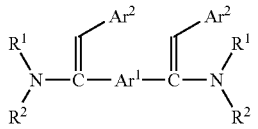

wherein each of $R^1$ and $R^2$ independently represents a substituted or unsubstituted alkyl group or an aromatic hydrocarbon group, or $R^1$ and $R^2$ may share bond connectivity to form a substituted or unsubstituted heterocyclic group containing a nitrogen atom; $Ar^1$ represents a substituted or unsubstituted divalent aromatic hydrocarbon group; and $Ar^2$ represents a substituted or unsubstituted monovalent aromatic hydrocarbon group.

Another exemplary embodiment provides an image forming method including charging the above electrophotographic photoreceptor, irradiating the charged electrophotographic photoreceptor with a light beam to form an electrostatic latent image thereon, developing the electrostatic latent image with a toner to form a toner image, and transferring the toner image onto a recording medium.

Yet another exemplary embodiment provides an image forming apparatus including the above electrophotographic photoreceptor configured to bear an electrostatic latent image, a charger configured to charge the electrophotographic photoreceptor, an irradiator configured to irradiate the charged electrophotographic photoreceptor with a light beam to form an electrostatic latent image thereon, a developing device configured to develop the electrostatic latent image with a toner to form a toner image, and a transfer device configured to transfer the toner image onto a recording medium.

Yet another exemplary embodiment provides a process cartridge detachably attachable to image forming apparatuses including the above electrophotographic photoreceptor configured to bear an electrostatic latent image, and at least one of a charger for charging the electrophotographic photoreceptor, an irradiator for irradiating the electrophotographic photoreceptor with a light beam, a developing device for developing an electrostatic latent image formed on the electrophotographic photoreceptor with a toner to form a toner image, a transfer device for transferring a toner image from the electrophotographic photoreceptor onto a recording medium, a cleaning device for removing residual toner particles from the electrophotographic photoreceptor, and a decharging device for decharging the electrophotographic photoreceptor.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
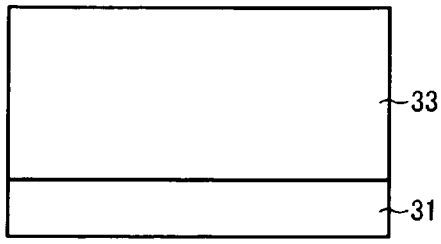
FIGS. 1 to 5 are schematic cross-sectional views illustrating exemplary embodiments of the photoreceptor of the present invention.

Exemplary embodiments of the electrophotographic photoreceptor, image forming method, image forming apparatus, and process cartridge of the present invention are described below.

Within the context of the present invention, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

The electrophotographic photoreceptor of the present invention includes a conductive substrate and a photosensitive layer located overlying the conductive substrate. The photosensitive layer comprises a diamine compound having the following formula (1):

(1)

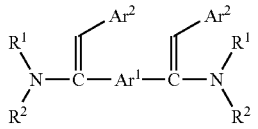

wherein each of $R^1$ and $R^2$ independently represents a substituted or unsubstituted alkyl group or an aromatic hydrocarbon group, or $R^1$ and $R^2$ may share bond connectivity to form a substituted or unsubstituted heterocyclic group containing a nitrogen atom; $Ar^1$ represents a substituted or unsubstituted divalent aromatic hydrocarbon group; and $Ar^2$ represents a substituted or unsubstituted monovalent aromatic hydrocarbon group.

By including the diamine compound having the formula (1) in the photosensitive layer, the photoreceptor can produce high quality images even after repeated use. The reason for this may be considered that the alkylamino groups, which are strong basic groups, in the formula (1) neutralize oxidizing gases which may cause image blurring. In particular, the diamine compounds having the formula (1) in which the amino groups are substituted with aromatic hydrocarbon groups have charge transport ability. By using another charge transport material in combination with the diamine compound having the formula (1), sensitivity and reliability may much more improve.

The diamine compound having the formula (1) is readily obtainable by a method disclosed in a technical document "A new synthesis of bisbenzils and novel poly(phenylquinoxaline)s therefrom (E. Elce and A. S. Hay, *Polymer* Vol. 37 No. 9, pp. 1745-1749, 1996)", the disclosures of which being incorporated herein by reference. More specifically, the diamine compound having the formula (1) can be obtained by reacting a diamine compound having the following formula (11) disclosed in Japanese Patent No. 4101676, the disclosures of which being incorporated herein by reference, with an aniline compound having the following formula (12) in the presence of a basic compound at a temperature of from room temperature to about 100° C.

(11)

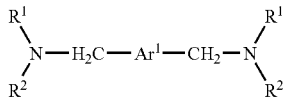

wherein each of $R^1$ and $R^2$ independently represents a substituted or unsubstituted alkyl group or an aromatic hydrocarbon group, or $R^1$ and $R^2$ may share bond connectivity to form a substituted or unsubstituted heterocyclic group containing a nitrogen atom; and $Ar^1$ represents a substituted or unsubstituted divalent aromatic hydrocarbon group.

(12)

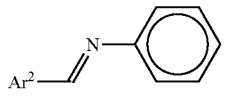

wherein $Ar^2$ represents a substituted or unsubstituted monovalent aromatic hydrocarbon group.

Specific examples of usable basic compounds for the above reaction include, but are not limited to, potassium carbonate, sodium carbonate, potassium hydroxide, sodium hydroxide, sodium hydride, sodium methylate, and potassium-t-butoxide. Specific examples of usable reaction solvents for the above reaction include, but are not limited to, dioxane, tetrahydrofuran, toluene, xylene, dimethylsulfoxide, N,N-dimethylformamide, N-methylpyrrolidone, 1,3-dimethyl-2-imidazolidinone, and acetonitrile.

Specific examples of the alkyl groups in the formulae (1) and (11) include, but are not limited to, methyl group, ethyl group, propyl group, butyl group, hexyl group, and undecanyl group. Specific examples of the monovalent or divalent aromatic hydrocarbon groups in the formulae (1), (11), and (12) include, but are not limited to, groups derived from aromatic rings such as benzene, biphenyl, naphthalene, anthracene, fluorene, and pyrene; and groups derived from aromatic heterocyclic rings such as pyridine, quinoline, thiophene, furan, oxazole, oxadiazole, and carbazole. Specific examples of substituents for the above-described groups include, but are not limited to, alkyl groups as described above; alkoxy groups such as methoxy group, ethoxy group, propoxy group, and butoxy group; halogen atoms such as fluorine, chlorine, bromine, and iodine; aromatic hydrocarbon groups as described above; and heterocyclic groups such as pyrrolidine, piperidine, and piperazine. When $R^1$ and $R^2$ share bond connectivity to form a heterocyclic group containing a nitrogen atom, the heterocyclic group may be a condensed heterocyclic group in which pyrrolidino group, piperidino group, or piperazino group and an aromatic hydrocarbon group are condensed.

Specific preferred examples of the compound having the formula (1) include compounds described in Tables 1 to 3, but are not limited thereto.

TABLE 1

| No. | $Ar^1$ | $Ar^2$ | $R^1$ | $R^2$ |
|---|---|---|---|---|
| 1 | 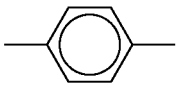 | 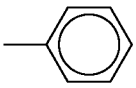 | $-CH_3$ | $-CH_3$ |
| 2 | 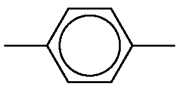 | 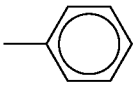 | $-CH_2CH_3$ | 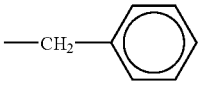 |

TABLE 1-continued
| No. | $Ar^1$ | $Ar^2$ | $R^1$ | $R^2$ |
|---|---|---|---|---|
| 3 | 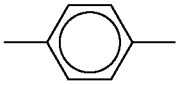 | 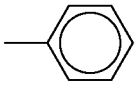 | 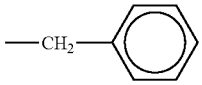 | 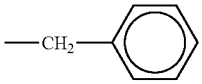 |
| 4 | 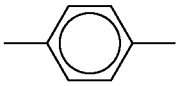 | 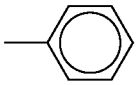 | $—CH_3$ | 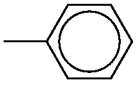 |
| 5 | 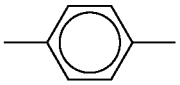 | 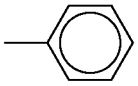 | $—CH_2CH_3$ | 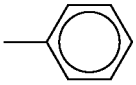 |
| 6 | 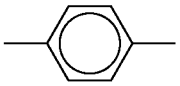 | 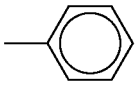 | $—CH_3$ | 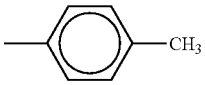 |
| 7 | 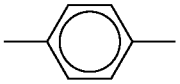 | 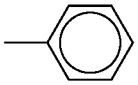 | $—CH_2CH_3$ | 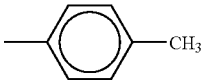 |
| 8 | 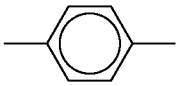 | 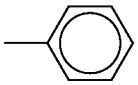 | $—CH_2CH_2CH_3$ | 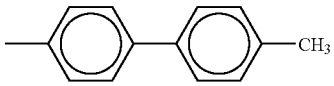 |
| 9 | 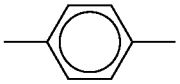 | 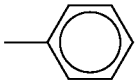 | $—CH_2CH_3$ | 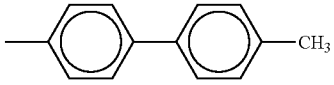 |
| 10 | 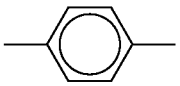 | 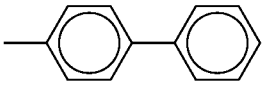 | 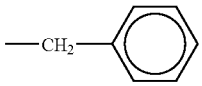 | 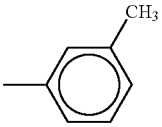 |
| 11 | 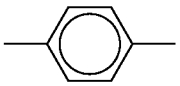 | 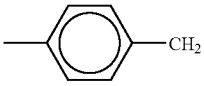 | 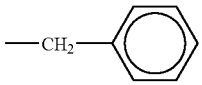 | 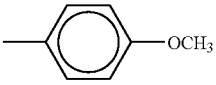 |
| 12 | 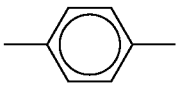 | 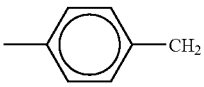 | $—CH_2CH_3$ | 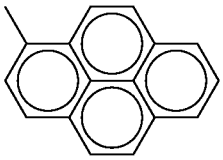 |
| 13 | 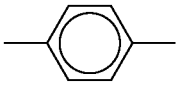 | 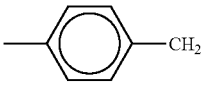 | 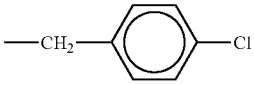 | 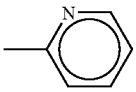 |
| 14 | 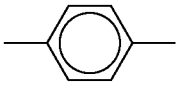 | 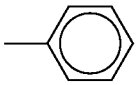 | $—CH_2CH_3$ | 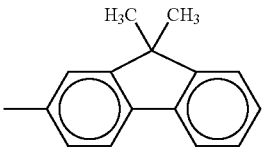 |
| 15 | 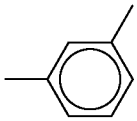 | 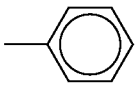 | $—CH_2CH_3$ | 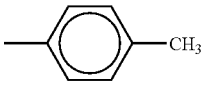 |

TABLE 2
| No. | $Ar^1$ | $Ar^2$ | $R^1$ | $R^2$ |
|---|---|---|---|---|
| 16 | 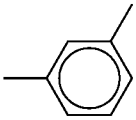 | 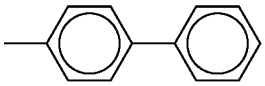 | 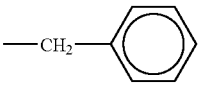 | 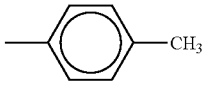 |
| 17 | 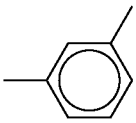 | 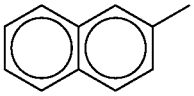 | 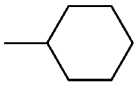 | 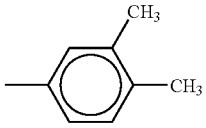 |
| 18 | 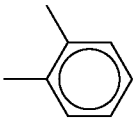 | 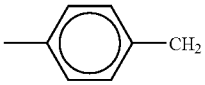 | $—CH_2CH_3$ | 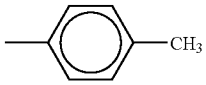 |
| 19 | 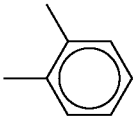 | 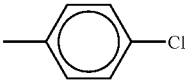 | $—CH_3$ | 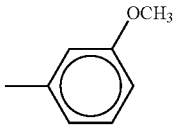 |
| 20 | 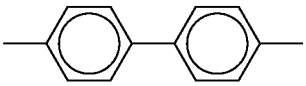 | 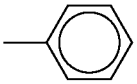 | $—CH_3$ | $—CH_3$ |
| 21 | 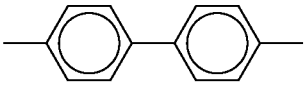 | 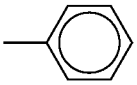 | $—CH_2CH_3$ | 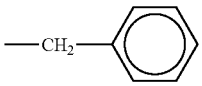 |
| 22 | 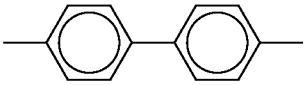 | 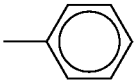 | 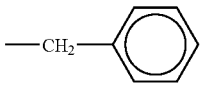 | 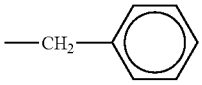 |
| 23 | 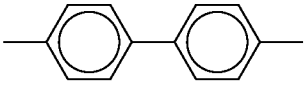 | 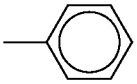 | $—CH_2CH_3$ | 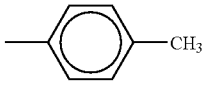 |
| 24 | 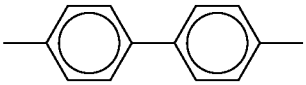 | 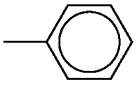 | 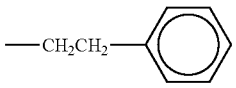 | 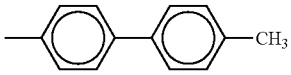 |
| 25 | 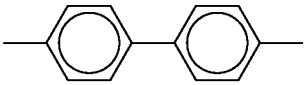 | 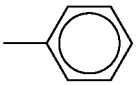 | $—CH_3$ | 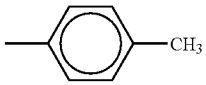 |
| 26 | 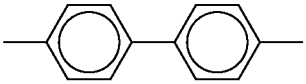 | 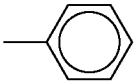 | $—CH_2CH_3$ | 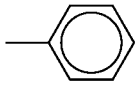 |
| 27 | 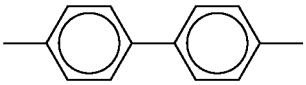 | 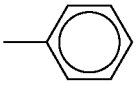 | 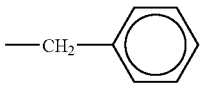 | 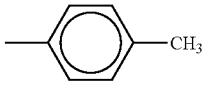 |
| 28 | 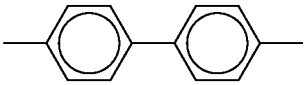 | 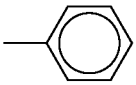 | 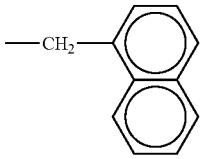 | 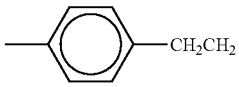 |
| 29 | 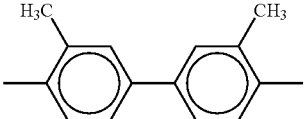 | 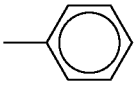 | $—CH_2CH_3$ | 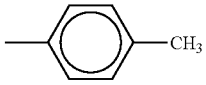 |

TABLE 3
| No. | $Ar^1$ | $Ar^2$ | $R^1$ | $R^2$ |
|---|---|---|---|---|
| 31 | 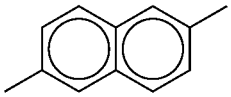 | 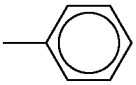 | $—CH_2CH_3$ | 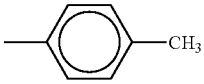 |
| 32 | 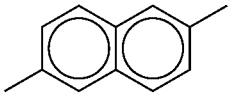 | 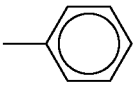 | $—CH_3$ | 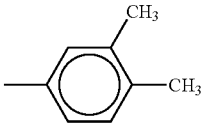 |
| 33 | 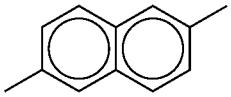 | 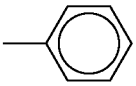 | 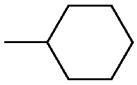 | 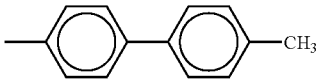 |
| 34 | 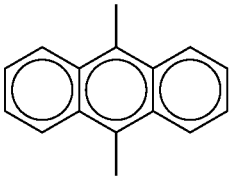 | 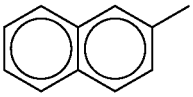 | $—CH_2CH_3$ | 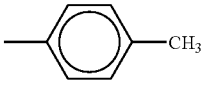 |
| 35 | 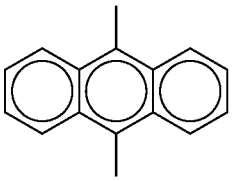 | 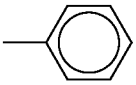 | $—CH_3$ | 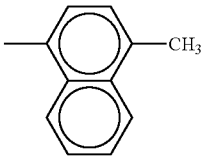 |
| 36 | 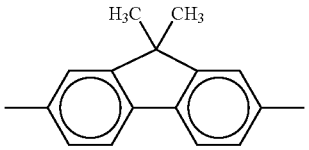 | 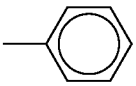 | $—CH_2CH_3$ | 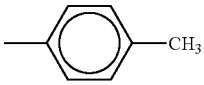 |
| 37 | 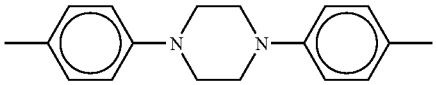 | 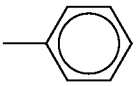 | $—CH_2CH_3$ | 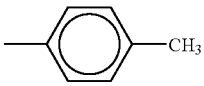 |
| 38 | 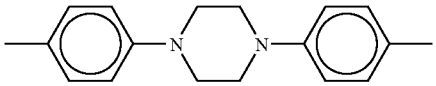 | 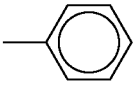 | $—CH_2CH_3$ | 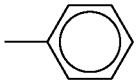 |
| 39 | 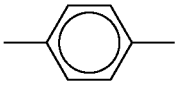 | 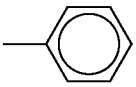 | $—CH_2CH_3$ | 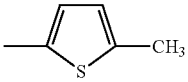 |
| 40 | 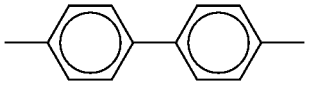 | 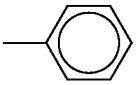 | $—CH_2CH_2CH_3$ $\vert$ $CH_3$ | 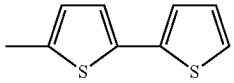 |

TABLE 3-continued

| No. | $Ar^1$ | $Ar^2$ | $R^1$ | $R^2$ |
|---|---|---|---|---|
| 41 | 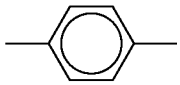 | 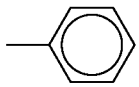 | | 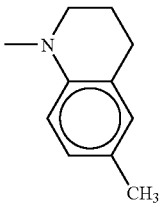 |
| 42 | 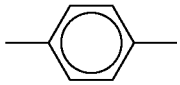 | 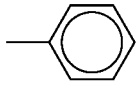 | | 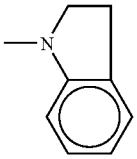 |
| 43 | 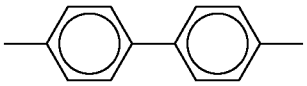 | 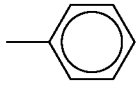 | | 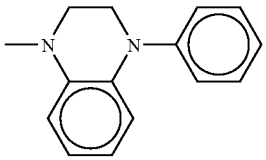 |

Exemplary layer structures of the photoreceptor of the present invention are described below with reference to FIGS. 1 to 5. FIGS. 1 to 5 are schematic cross-sectional views illustrating exemplary embodiments of the photoreceptor of the present invention.

Referring to FIG. 1, a photosensitive layer 33 comprising a charge generation material and a charge transport material is provided on a conductive substrate 31.

Figure 2:
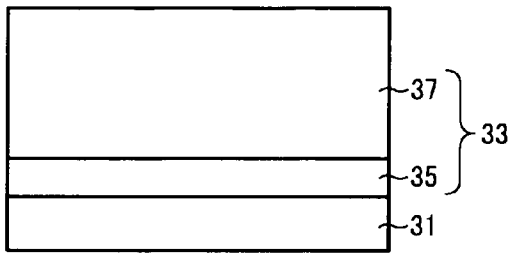

Referring to FIG. 2, a charge generation layer 35 comprising a charge generation material and a charge transport layer 37 comprising a charge transport material are provided in this order on a conductive substrate 31.

Figure 3:
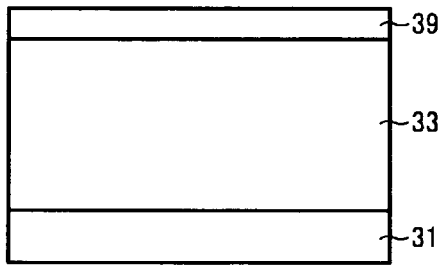

Referring to FIG. 3, a photosensitive layer 33 comprising a charge generation material and a charge transport material is provided on a conductive substrate 31, and a protective layer 39 is further provided on the photosensitive layer 33. The protective layer 39 may include the diamine compounds described above.

Figure 4:
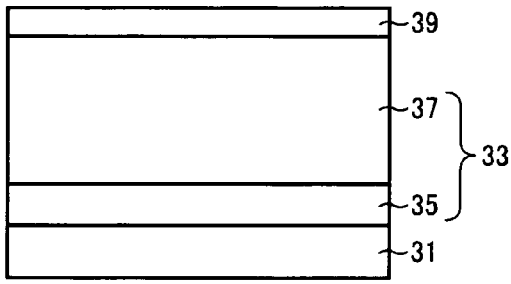

Referring to FIG. 4, a charge generation layer 35 comprising a charge generation material and a charge transport layer 37 comprising a charge transport material are provided in this order on a conductive substrate 31, and a protective layer 39 is further provided on the charge transport layer 37. The protective layer 39 may include the diamine compounds described above.

Figure 5:
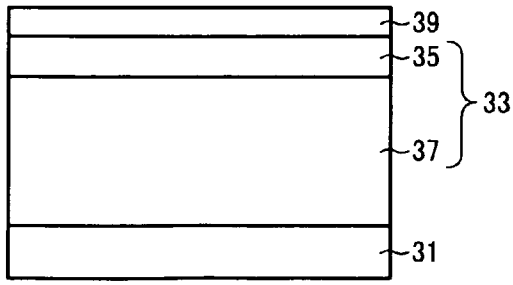

Referring to FIG. 5, a charge transport layer 37 comprising a charge transport material and a charge generation layer 35 comprising a charge generation material are provided in this order on a conductive substrate 31, and a protective layer 39 is further provided on the charge generation layer 35. The protective layer 39 may include the diamine compounds described above.

Suitable materials for the conductive substrate 31 include conductive materials having a volume resistivity of $10^{10}\Omega\cdot$cm or less. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxide, indium oxide, and the like, is formed by deposition or sputtering. In addition, a metal cylinder can also be used as the conductive substrate 31, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, an endless nickel belt and an endless stainless steel belt disclosed in Examined Japanese Application Publication No. 52-36016, the disclosure thereof being incorporated herein by reference, can be also used as the conductive substrate 31.

Further, substrates, in which a conductive layer is formed on the above-described conductive substrates by applying a coating liquid including a binder resin and a conductive powder thereto, can be used as the conductive substrate 31. Specific examples of usable conductive powders include, but are not limited to, carbon black, acetylene black, powders of metals such as aluminum, nickel, iron, nichrome, copper, zinc, and silver, and powders of metal oxides such as conductive tin oxides and ITO. Specific examples of usable binder resins include thermoplastic, thermosetting, and photocrosslinking resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. Such a conductive layer can be formed by coating a coating liquid in which a conductive powder and a binder resin are dispersed or dissolved in a proper solvent such as tetrahydrofuran, dichloromethane, methyl ethyl ketone, and toluene, and then drying the coated liquid.

In addition, substrates, in which a conductive layer is formed on a surface of a cylindrical substrate using a heat-shrinkable tube which is made of a combination of a resin such as polyvinyl chloride, polypropylene, polyester, polystyrene, polyvinylidene chloride, polyethylene, chlorinated rubber, and TEFLON®, with a conductive powder, can also be used as the conductive substrate 31.

Exemplary embodiments of the photosensitive layer 33 are described below. The photosensitive layer 33 may be either single-layered or multilayer. When the photosensitive layer 33 is multilayer and comprises the charge generation layer 35 and the charge transport layer 37, it is preferable that the diamine compound having the formula (1) is included in the charge transport layer 37.

The charge generation layer 35 includes a charge generation material as a main component. Specific examples of usable charge generation materials include, but are not limited to, azo pigments such as C. I. Pigment Blue 25 (Color Index 21180), C. I. Pigment Red 41 (Color Index 21200), C. I. Acid Red 52 (Color Index 45100), C. I. Basic Red 3 (Color Index 45210), azo pigments having a carbazole skeleton (described in JP-A 53-95033, the disclosures thereof being incorporated herein by reference), azo pigments having a distyrylbenzene skeleton (described in JP-A 53-133445, the disclosures thereof being incorporated herein by reference), azo pigments having a triphenylamine skeleton (described in JP-A 53-132347, the disclosures thereof being incorporated herein by reference), azo pigments having a dibenzothiophene skeleton (described in JP-A 54-21728, the disclosures thereof being incorporated herein by reference), azo pigments having an oxadiazole skeleton (described in JP-A 54-12742, the disclosures thereof being incorporated herein by reference), azo pigments having a fluorenone skeleton (described in JP-A 54-22834, the disclosures thereof being incorporated herein by reference), azo pigments having a bisstilbene skeleton (described in JP-A 54-17733, the disclosures thereof being incorporated herein by reference), azo pigments having a distyryloxadiazole skeleton (described in JP-A 54-2129, the disclosures thereof being incorporated herein by reference), azo pigments having a distyrylcarbazole skeleton (described in JP-A 54-14967, the disclosures thereof being incorporated herein by reference), and azo pigments having a benzanthrone skeleton; phthalocyanine pigments such as C. I. Pigment Blue 16 (Color Index 74100), Y-type oxo-titanium phthalocyanine (described in JP-A 64-17066, the disclosures thereof being incorporated herein by reference), A (β)-type oxo-titanium phthalocyanine, B(α)-type oxo-titanium phthalocyanine, I-type oxo-titanium phthalocyanine (described in JP-A 11-21466, the disclosures thereof being incorporated herein by reference), II-type chlorogalliumphthalocyanine (described in the abstract of "(1B4 04) New Polymorphs of Chlorogallium Phthalocyanine and Their Photogenerating Properties" presented by Iijima et al. in the $67^{th}$ annual meeting of the Chemical Society of Japan in 1994, the disclosures thereof being incorporated herein by reference), V-type hydroxygalliumphthalocyanine (described in the abstract of "(1B4 05) A New Polymorph of Hydroxy Gallium phthalocyanine and Its application for Photoreceptor" presented by Daimon et al. in the $67^{th}$ annual meeting of the Chemical Society of Japan in 1994, the disclosures thereof being incorporated herein by reference), and X-type metal-free phthalocyanine (described in U.S. Pat. No. 3,816,118); indigo pigments such as C. I. Vat Brown 5 (Color Index 73410) and C. I. Vat Dye (Color Index 73030); and perylene pigments such as ALGOL SCARLET B and INDANTHRENE SCARLET R (both from Bayer AG). These materials can be used alone or in combination.

The charge generation layer 35 may be formed by applying a charge generation layer coating liquid on a conductive substrate, followed by drying. The charge generation layer coating liquid may be prepared by dispersing a charge generation material, optionally along with a binder resin, in a solvent using a ball mill, an attritor, a sand mill, or an ultrasonic disperser.

Specific examples of binder resins optionally included in the charge generation layer 35 include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzol, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. The content of the binder resin in the charge generation layer 35 is preferably from 0 to 500 parts by weight, and more preferably from 10 to 300 parts by weight, per 100 parts by weight of the charge generation material included in the charge generation layer 35. The binder resin may be added to the coating liquid either before or after the charge generation material is dispersed therein.

Specific examples of usable solvents for the charge generation material coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferable. These solvents can be used alone or in combination.

The charge generation layer coating liquid includes the charge generation material, the solvent, and the binder resin as main components, and may optionally include additives such as an intensifier, a dispersing agent, a surfactant, and a silicone oil.

Suitable coating methods for forming the charge generation layer 35 include, but are not limited to, a dip coating method, a spray coating method, a bead coating method, a nozzle coating method, a spinner coating method, and a ring coating method. The charge generation layer 35 preferably has a thickness of from 0.01 to 0.5 μm, and more preferably from 0.1 to 2 μm.

The charge transport layer 37 includes a charge transport material as a main component and further includes the diamine compounds having the formula (1). Charge transport materials are hereinafter classified into hole transport materials, electron transport materials, and charge transport polymers.

Specific preferred examples of suitable hole transport materials include, but are not limited to, poly-N-carbazole and derivatives thereof, poly-γ-carbazolylethyl glutamate and derivatives thereof, pyrene-formaldehyde condensates and derivatives thereof, polyvinyl pyrene, polyvinyl phenanthrene, oxazole derivatives, imidazole derivatives, triphenylamine derivatives, and compounds having the following formulae (2), (6), and (13) to (31).

(13)

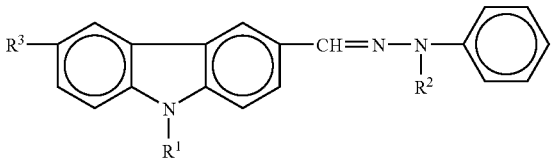

wherein $R^1$ represents a methyl group, an ethyl group, a 2-hydroxyethyl group, or a 2-chloroethyl group; $R^2$ represents a methyl group, an ethyl group, a benzyl group, or a phenyl group; $R^3$ represents a hydrogen atom, a chlorine atom, a bromine atom, an alkyl group having 1 to 4 carbon atoms, an alkoxy group having 1 to 4 carbon atoms, a dialkylamino group, or a nitro group.

Specific examples of the compound having the formula (13) include, but are not limited to, 9-ethylcarbazole-3-aldehyde-1-methyl-1-phenylhydrazone, 9-ethylcarbazole-3-aldehyde-1-benzyl-1-phenylhydrazone, and 9-ethylcarbazole-3-aldehyde-1,1-diphenylhydrazone.

(14)

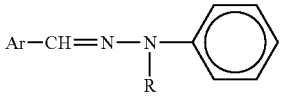

wherein Ar represents a naphthalene ring or a substitution thereof, an anthracene ring or a substitution thereof, a pyrene ring or a substitution thereof, a pyridine ring, a furan ring, or a thiophene ring; and R represents an alkyl group, a phenyl group, or a benzyl group.

Specific examples of the compound having the formula (14) include, but are not limited to, 4-diethylaminostyryl-β-aldehyde-1-methyl-1-phenylhydrazone and 4-methoxynaphthalene-1-aldehyde-1-benzyl-1-phenylhydrazone.

(15)

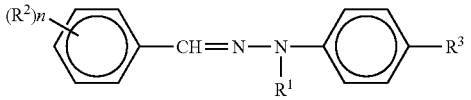

wherein $R^1$ represents an alkyl group, a benzyl group, a phenyl group, or a naphthyl group; $R^2$ represents a hydrogen atom, an alkyl group having 1 to 3 carbon atoms, an alkoxy group having 1 to 3 carbon atoms, a dialkylamino group, a diaralkylamino group, or a substituted or unsubstituted diarylamino group; n represents an integer of from 1 to 4; when n is 2 or more, multiple $R^2$ may be, but need not necessarily be, the same; and $R^3$ represents a hydrogen atom or a methoxy group.

Specific examples of the compound having the formula (15) include, but are not limited to, 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

(16)

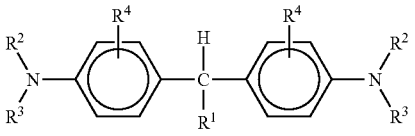

wherein $R^1$ represents an alkyl group having 1 to 11 carbon atoms, a substituted or unsubstituted phenyl group, or a heterocyclic group; each of $R^2$ and $R^3$ independently represents a hydrogen atom, an alkyl group having 1 to 4 carbon atoms, a hydroxyalkyl group, a chloroalkyl group, or a substituted or unsubstituted aralkyl group; $R^2$ and $R^3$ may share bond connectivity to form a heterocyclic ring containing a nitrogen atom; each of multiple $R^4$ independently represents a hydrogen atom, an alkyl group having 1 to 4 carbon atoms, an alkoxy group, or a halogen atom.

Specific examples of the compound having the formula (16) include, but are not limited to, 1,1-bis(4-dibenzylaminophenyl) propane, tris(4-diethylaminophenyl)methane, and 2,2'-dimethyl-4,4'-bis(diethylamino)-triphenylmethane.

(17)

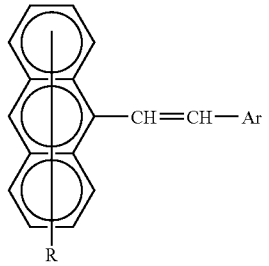

wherein R represents a hydrogen atom or a halogen atom; and Ar represents a substituted or unsubstituted phenyl, naphthyl, anthryl, or carbazolyl group.

Specific examples of the compound having the formula (17) include, but are not limited to, 9-(4-diethylaminostyryl) anthracene and 9-bromo-10-(4-diethylaminostyryl)anthracene.

(18)

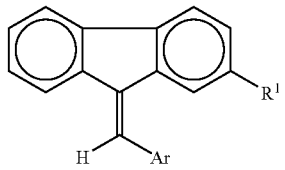

wherein $R^1$ represents a hydrogen atom, a halogen atom, a cyano group, an alkoxy group having 1 to 4 carbon atoms, or an alkyl group having 1 to 4 carbon atoms; and Ar represents a group having the following formula (19) or (20):

(19)

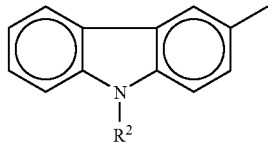

(20)

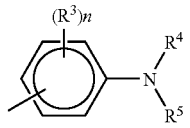

wherein $R^2$ represents an alkyl group having 1 to 4 carbon atoms; $R^3$ represents a hydrogen atom, a halogen atom, an alkyl group, having 1 to 4 carbon atoms, an alkoxy group having 1 to 4 carbon atoms, or a dialkylamino group; n represents an integer of 1 or 2; when n is 2, multiple $R^3$ may be, but need not necessarily be, the same; and each of $R^4$ and $R^5$ independently represents a hydrogen atom, a substituted or unsubstituted alkyl group having 1 to 4 carbon atoms, or a substituted or unsubstituted benzyl group.

Specific examples of the compound having the formula (18) include, but are not limited to, 9-(4-dimethylaminobenzylidene)fluorenone and 3-(9-fluorenylidene)-9-ethylcarbazole.

(21)

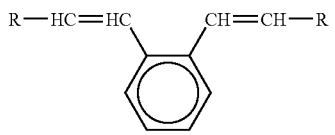

wherein R represents a carbazolyl group, a pyridyl group, a thienyl group, an indolyl group, a furyl group, a substituted or unsubstituted phenyl group, a substituted or unsubstituted styryl group, a substituted or unsubstituted naphthyl group, or a substituted or unsubstituted anthryl group; and substituent groups thereof are selected from the group consisting of a dialkylamino group, an alkyl group, an alkoxy group, a carboxyl group or an ester thereof, a halogen atom, a cyano group, an aralkylamino group, an N-alkyl-N-aralkylamino group, an amino group, a nitro group, and an acetylamino group.

Specific examples of the compound having the formula (21) include, but are not limited to, 1,2-bis(4-diethylaminostyryl)benzene and 1,2-bis(2,4-dimethoxystyryl)benzene.

(22)

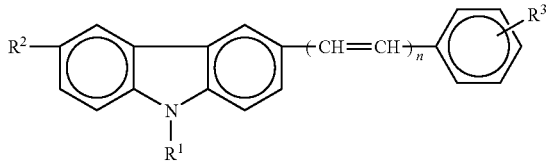

wherein $R^1$ represents a lower alkyl group, a substituted or unsubstituted phenyl group, or a benzyl group; each of $R^2$ and $R^3$ independently represents a hydrogen atom, a lower alkyl group, a lower alkoxy group, a halogen atom, a nitro group, an amino group, or an amino group substituted with a lower alkyl group or a benzyl group; and n represents an integer of 1 or 2.

Specific examples of the compound having the formula (22) include, but are not limited to, 3-styryl-9-ethylcarbazole and 3-(4-methoxystyryl)-9-ethylcarbazole.

(23)

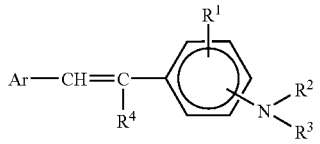

wherein $R^1$ represents a hydrogen atom, an alkyl group, an alkoxy group, or a halogen atom; each of $R^2$ and $R^3$ independently represents a substituted or unsubstituted aryl group; $R^4$ represents a hydrogen atom, a lower alkyl group, or a substituted or unsubstituted phenyl group; and Ar represents a substituted or unsubstituted phenyl or naphthyl group.

Specific examples of the compound having the formula (23) include, but are not limited to, 4-diphenylaminostilbene, 4-dibenzylaminostilbene, 4-ditolylaminostilbene, and 1-(4-diphenylaminostyryl) naphthalene.

(2)

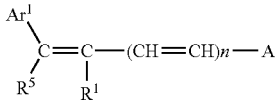

wherein n represents an integer of 0 or 1; $R^1$ represents an alkyl group or a substituted or unsubstituted phenyl group; $Ar^1$ represents a substituted or unsubstituted aromatic hydrocarbon group; $R^5$ represents an alkyl group having 1 to 4 carbon atoms or a substituted or unsubstituted aromatic hydrocarbon group; $Ar^1$ and $R^5$ may share bond connectivity to form a ring; and A represents a 9-anthryl group, a substituted or unsubstituted carbazolyl group, or a group having the following formula (3) or (4):

(3)

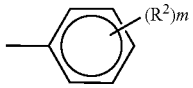

(4)

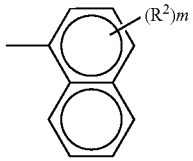

wherein $R^2$ represents a hydrogen atom, an alkyl group, an alkoxy group, a halogen atom, or a group having the following formula (5):

(5)

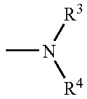

wherein each of $R^3$ and $R^4$ independently represents a substituted or unsubstituted aromatic hydrocarbon group, or $R^3$ and $R^4$ may share bond connectivity to form a ring; m represents an integer of from 1 to 3; when m is 2 or more, multiple $R^2$ may be, but need not necessarily be, the same; and when n is 0, A and $R^1$ may share bond connectivity to form a ring.

Specific examples of the compound having the formula (2) include, but are not limited to, 4'-diphenylamino-α-phenylstilbene and 4'-bis(4-methylphenyl)amino-α-phenylstilbene (24)

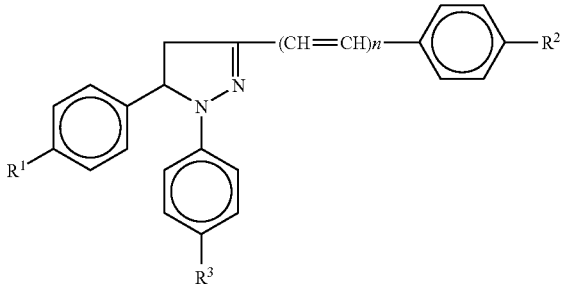

wherein each of $R^2$, and $R^3$ independently represents a hydrogen atom, a lower alkyl group, a lower alkoxy group, a halogen atom, or a dialkylamino group; and n represents an integer of 0 or 1.

Specific examples of the compound having the formula (24) include, but are not limited to, 1-phenyl-3-(4-diethylaminostyryl)-5-(4-diethylaminophenyl)pyrazoline.

(25)

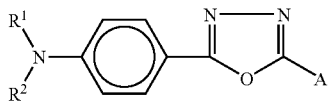

wherein each of $R^1$ and $R^2$ independently represents a substituted or unsubstituted alkyl group or a substituted or unsubstituted aryl group; and A represents a substituted amino group, a substituted or unsubstituted aryl group, or a substituted or unsubstituted allyl group.

Specific examples of the compound having the formula (25) include, but are not limited to, 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

(26)

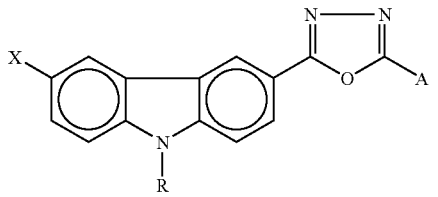

wherein X represents a hydrogen atom, a lower alkyl group, or a halogen atom; R represents a substituted or unsubstituted alkyl group or a substituted or unsubstituted aryl group; and A represents a substituted amino group or a substituted or unsubstituted aryl group.

Specific examples of the compound having the formula (26) include, but are not limited to, 2-N, N-diphenylamino-5-(N-ethylcarbazole-3-yl)-1,3,4-oxadiazole and 2-(4-diethylaminophenyl)-5-(N-ethylcarbazole-3-yl)-1,3,4-oxadiazole.

(27)

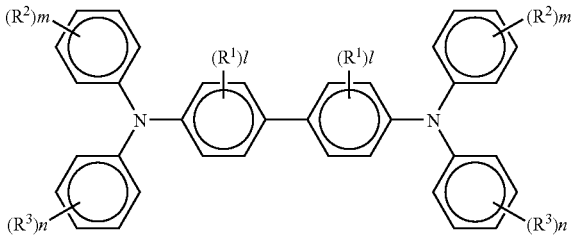

wherein $R^1$ represents a lower alkyl group, a lower alkoxy group, or a halogen atom; each of $R^2$ and $R^3$ independently represents a hydrogen atom, a lower alkyl group, a lower alkoxy group, or a halogen atom; and each of l, m, and n independently represents an integer of from 0 to 4.

Specific examples of the benzidine compound having the formula (27) include, but are not limited to, N,N'-diphenyl-N,N'-bis(3-methylphenyl)-[1,1'-biphenyl]-4,4'-diamine and 3,3'-dimethyl-N,N,N',N'-tetrakis(4-methylphenyl)-[1,1'-biphenyl]-4,4'-diamine.

(6)

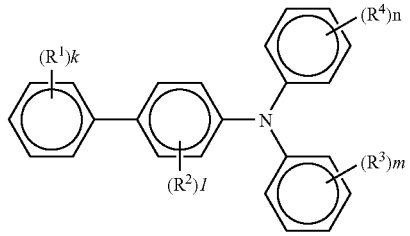

wherein each of $R^1$, $R^3$, and $R^4$ independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aryl group; $R^2$ represents a hydrogen atom, an alkoxy group, a substituted or unsubstituted alkyl group, or a halogen atom; each of k, l, m, and n independently represents an integer of from 1 to 4; and when each of k, l, m, and n is an integer of from 2 to 4, multiple $R^1$, $R^2$, $R^3$, and $R^4$ may be, but need not necessarily be, the same.

Specific examples of the biphenylylamine compound having the formula (6) include, but are not limited to, 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

(28)

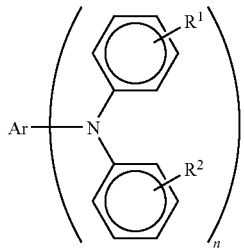

wherein Ar represents a condensed polycyclic hydrocarbon group having 18 or less carbon atoms which may have a substituent group; each of $R^1$ and $R^2$ independently represents a hydrogen atom, a halogen atom, a substituted or unsubstituted alkyl group, an alkoxy group, or a substituted or unsubstituted phenyl group; and n represents an integer of 1 or 2.

Specific examples of the triarylamine compound having the formula (28) include, but are not limited to, N,N-diphenyl-pyrene-1-amine, N,N-di-p-tolyl-pyrene-1-amine, N,N-di-p-tolyl-1-naphthylamine, N,N-di(p-tolyl)-1-phenanthrylamine, 9,9-dimethyl-2-(di-p-tolylamino)fluorene, N,N,N',N'-tetrakis(4-methylphenyl)-phenanthrene-9,10-diamine, and N,N,N',N'-tetrakis(3-methylphenyl)-m-phenylenediamine.

$$A\text{-}CH{=}CH{-}Ar{-}CH{=}CH\text{-}A \quad (29)$$

wherein Ar represents a substituted or unsubstituted aromatic hydrocarbon group; and A represents a group having the following formula (30):

(30)

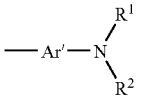

wherein Ar' represents a substituted or unsubstituted divalent aromatic hydrocarbon group; and each of $R^1$ and $R^2$ independently represents a substituted or unsubstituted alkyl group or a substituted or unsubstituted aryl group.

Specific examples of the diolefin aromatic compound having the formula (29) include, but are not limited to, 1,4-bis(4-diphenylaminostyryl)benzene and 1,4-bis[4-di(p-tolyl)aminostyryl]benzene.

(31)

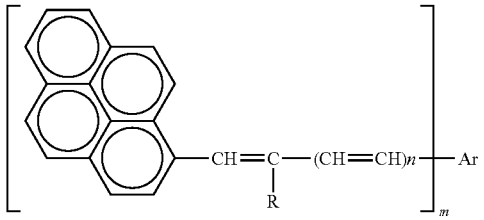

wherein Ar represents a substituted or unsubstituted aromatic hydrocarbon group; R represents a hydrogen atom, a substituted or unsubstituted alkyl group, or a substituted or unsubstituted aryl group; n represents an integer of 0 or 1 and m represents an integer of 1 or 2; and when n is 0 and m is 1, Ar and R may share bond connectivity to form a ring.

Specific examples of the styrylpyrene compound having the formula (31) include, but are not limited to, 1-(4-diphenylaminostyryl)pyrene and 1-(N,N-di-p-tolyl-4-aminostyryl)pyrene.

Among the above-described charge transport materials, compounds having the formula (2) or (6) are preferable. This is because compounds having the formulae (2) or (6) are low-molecular-weight charge transport materials which have excellent mobility, charge-injection property, and electrostatic fatigue property. These compounds can provide highly sensitive and reliable photoreceptors.

Specific preferred examples of suitable electron transport materials include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and compounds having the following formulae (32) to (35):

(32)

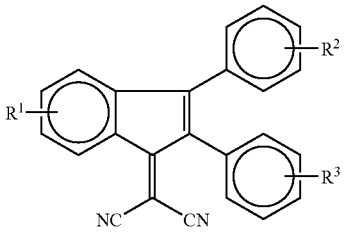

wherein each of $R^1$, $R^2$, and $R^3$ independently represents a hydrogen atom, a halogen atom, a substituted or unsubstituted alkyl group, an alkoxy group; or a substituted or unsubstituted phenyl group;

(33)

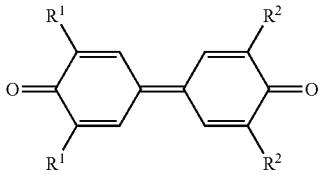

wherein each of $R^1$ and $R^2$ independently represents a hydrogen atom, a substituted or unsubstituted alkyl group, or a substituted or unsubstituted phenyl group;

(34)

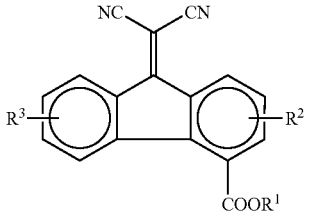

wherein each of $R^1$, $R^2$, and $R^3$ independently represents a hydrogen atom, a halogen atom, a substituted or unsubstituted alkyl group, an alkoxy group, or a substituted or unsubstituted phenyl group;

(35)

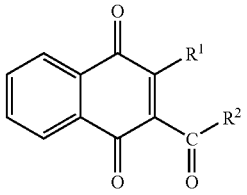

wherein $R^1$ represents an alkyl group which may have a substituent group or an aryl group which may have a substituent group; $R^2$ represents an alkyl group which may have a substituent group, an aryl group which may have a substituent group, or a group having the following formula (36):

$$—O—R_3 \quad (36)$$

wherein $R^3$ represents an alkyl group which may have a substituent group or an aryl group which may have a substituent group.

These charge transport materials can be used alone or in combination.

Specific examples of usable binder resins for the charge transport layer 37 include, but are not limited to, thermoplastic and thermosetting resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethylcellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins.

A total amount of the charge transport material and the diamine compound having the formula (1) included in the charge transport layer 37 is preferably from 20 to 300 parts by weight, and more preferably from 40 to 150 parts by weight, per 100 parts by weight of the binder resin. The charge transport layer 37 preferably has a thickness of 25 μm or less, from the viewpoint of image resolution and responsiveness, and 5 μm or more. However, the lower limit depends on the system, in particular the charging potential, for which the photoreceptor is used.

Further, the content of the diamine compound having the formula (1) is preferably from 0.01 to 150% by weight based on the charge transport material. When the content of the diamine compound having the formula (1) is too small, the resultant photoreceptor has poor resistance to oxidizing gases. When the content of the diamine compound having the formula (1) is too large, residual potential considerably increases by repeated use.

Specific preferred examples of suitable solvents for forming the charge transport layer 37 include, but are not limited to, tetrahydrofuran, dioxane, toluene, dichloromethane, monochlorobenzene, dichloroethane, cyclohexanone, methyl ethyl ketone, and acetone. The charge transport materials can be used alone or in combination.

The charge transport layer 37 may include an antioxidant. Specific preferred examples of suitable antioxidants include hydroquinone compounds and hindered amine compounds. Such antioxidants prevent deterioration of the diamine compounds having the formula (1). The antioxidant is preferably added to a coating liquid before the diamine compound having the formula (1) is added thereto. The added amount of the antioxidant is preferably from 0.1 to 200% by weight based on the diamine compound having the formula (1).

Charge transport polymers, which have functions of both a binder resin and a charge transport material, can be preferably used for the charge transport layer 37 because the resultant charge transport layer has good abrasion resistance. Specific preferred examples of usable charge transport polymers include, but are not limited to, polycarbonates having a triarylamine structure in a main chain and/or side chain thereof. More specifically, charge transport polymers having the following formulae (7), (10), and (37) to (45) are preferable:

(7)

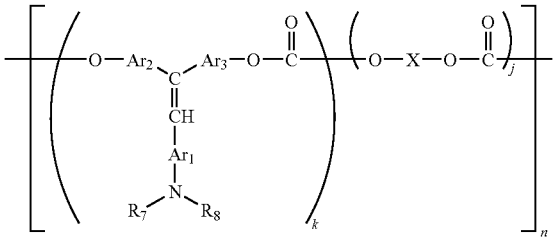

wherein each of $R_7$ and $R_8$ independently represents a substituted or unsubstituted monovalent aromatic group; each of $Ar_1$, $Ar_2$, and $Ar_3$ independently represents a divalent aromatic group; k represents a numeral of from 0.1 to 1; j represents a numeral of from 0 to 0.9; n represents an integer of from 5 to 5,000; and X represents an aliphatic divalent group, an alicyclic divalent group, or a divalent group having the following formula (8):

(8)

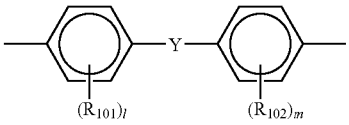

wherein each of $R_{101}$ and $R_{102}$ independently represents a substituted or unsubstituted alkyl group, an aromatic group, or a halogen atom; each of l and m independently represents an integer of from 0 to 4; Y represents a single bond, a straight-chain, branched-chain, or cyclic alkylene group having 1 to 12 carbon atoms, —O—, —S—, —SO—, —$SO_2$—, —CO—, —CO—O—Z—O—CO— (Z represents an aliphatic divalent group), or a group having the following formula (9):

(9)

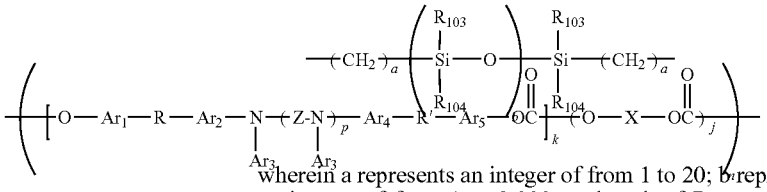

(10)

wherein a represents an integer of from 1 to 20; b represents an integer of from 1 to 2,000; and each of $R_{103}$ and $R_{104}$ independently represents a substituted or unsubstituted alkyl group or an aryl group;

wherein each of $Ar_1$, $Ar_2$, $Ar_4$ and $Ar_5$ independently represents a substituted or unsubstituted divalent aromatic group; $Ar_3$ represents a substituted or unsubstituted monovalent aromatic group; Z represents a divalent aromatic group or —$Ar_6$-Za-$Ar_6$— ($Ar_6$ represents a substituted or unsubstituted divalent aromatic group and Za represents O, S, or an alkylene group); each of R and R' independently represents a straight-chain or branched-chain alkylene group; p represents an integer of 0 or 1; and k, j, n, and X are as defined in the formula (7);

(37)

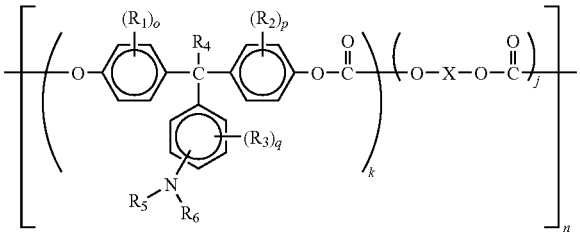

wherein each of $R_1$, $R_2$, and $R_3$ independently represents a substituted or unsubstituted alkyl group or a halogen atom; $R_4$ represents a hydrogen atom or a substituted or unsubstituted alkyl group; each of $R_5$ and $R_6$ independently represents a substituted or unsubstituted aryl group; each of o, p, and q independently represents an integer of from 0 to 4; and k, j, n, and X are as defined in the formula (7);

(38)

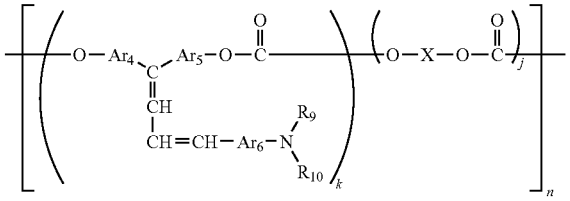

wherein each of $R_9$ and $R_{10}$ independently represents a substituted or unsubstituted aryl group; each of $Ar_4$, $Ar_5$, and $Ar_6$ independently represents an arylene group; and k, j, n, and X are as defined in the formula (7);

(39)

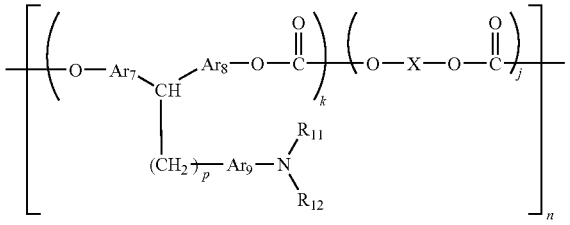

wherein each of $R_{11}$ and $R_{12}$ independently represents a substituted or unsubstituted aryl group; each of $Ar_7$, $Ar_8$, and $Ar_9$ independently represents an arylene group; p represents an integer of from 1 to 5; and k, j, n, and X are as defined in the formula (7);

wherein each of $R_{13}$ and $R_{14}$ independently represents a substituted or unsubstituted aryl group; each of $Ar_{10}$, $Ar_{11}$, and $Ar_{12}$ independently represents an arylene group; each of $X_1$ and $X_2$ independently represents a substituted or unsubstituted ethylene group or a substituted or unsubstituted vinylene group; and k, j, n, and X are as defined in the formula (7);

(41)

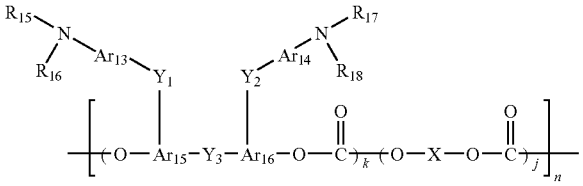

wherein each of $R_{15}$, $R_{16}$, $R_{17}$, and $R_{18}$ independently represents a substituted or unsubstituted aryl group; each of $Ar_{13}$, $Ar_{14}$, $Ar_{15}$, and $Ar_{16}$ independently represents an arylene group; each of $Y_1$, $Y_2$, and $Y_3$ independently represents a single bond, a substituted or unsubstituted alkylene group, a substituted or unsubstituted cycloalkylene group, a substituted or unsubstituted alkylene ether group, an oxygen atom, a sulfur atom, or a vinylene group; and k, j, n, and X are as defined in the formula (7);

(42)\

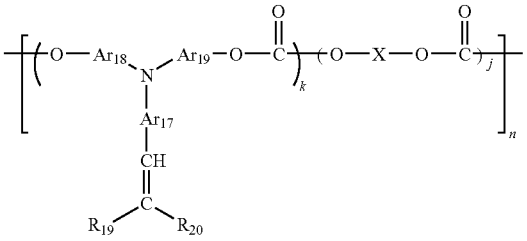

wherein each of $R_{19}$ and $R_{20}$ independently represents a hydrogen atom or a substituted or unsubstituted aryl group; $R_{19}$ and $R_{20}$ may share bond connectivity to form a ring; each of $Ar_{17}$, $Ar_{18}$, and $Ar_{19}$ independently represents an arylene group; and k, j, n, and X are as defined in the formula (7);

(40)

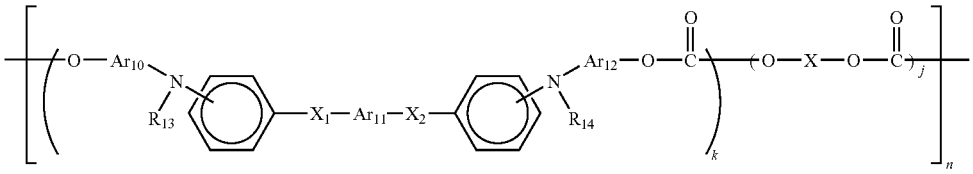

(43)

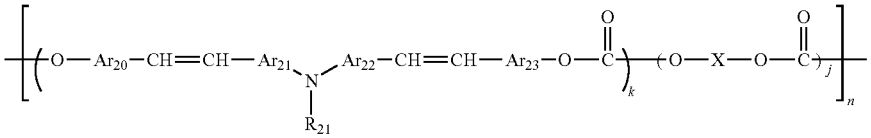

wherein $R_{21}$ represents a substituted or unsubstituted aryl group; each of $Ar_{20}$, $Ar_{21}$, $Ar_{22}$, and $Ar_{23}$ independently represents an arylene group; and k, j n, and X are as defined in the formula (7);

(44)

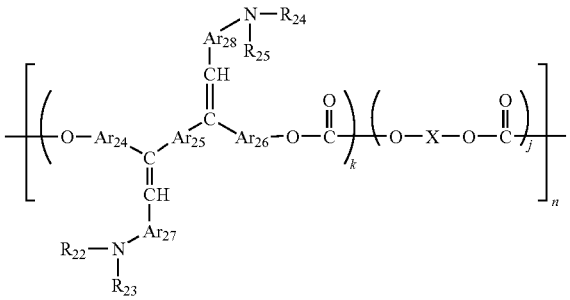

wherein each of $R_{22}$, $R_{23}$, $R_{24}$, and $R_{25}$ independently represents a substituted or unsubstituted aryl group; each of $Ar_{24}$, $Ar_{25}$, $Ar_{26}$, $Ar_{27}$, and $Ar_{28}$ independently represents an arylene group; and k, j, n, and X are as defined in the formula (7); and (45)

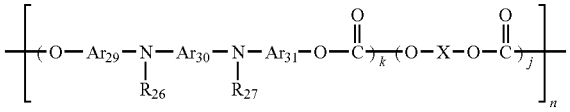

wherein each of $R_{26}$ and $R_{27}$ independently represents a substituted or unsubstituted aryl group; each of $Ar_{29}$, $Ar_{30}$, and $Ar_{31}$ independently represents an arylene group; and k, j, n, and X are as defined in the formula (7).

The charge transport layer 37 may be prepared by applying a charge transport layer coating liquid on the charge generation layer 35, followed by drying. The charge transport layer coating liquid may be prepared by dissolving or dispersing a charge transport material in a solvent optionally together with a binder resin. The charge transport layer coating liquid may optionally include one or more of a plasticizer, a leveling agent, antioxidant, and the like.

Suitable coating methods include, but are not limited to, a dip coating method, a spray coating method, a bead coating method, a nozzle coating method, a spinner coating method, and a ring coating method.

Among the above-described charge transport polymers, compounds having the formula (7) or (10) are preferable because these compounds have high abrasion resistance and high mobility. Accordingly, these compounds provide highly durable and sensitive photoreceptors.

Description is now made of the photosensitive layer 33 which is single-layered referring to FIGS. 1 and 3. The photosensitive layer 33 may be formed by applying a coating liquid on a conductive substrate, followed by drying. The coating liquid may be prepared by dispersing or dissolving a charge generation material, a charge transport material, a binder resin in a solvent. The coating liquid may optionally include a plasticizer, a leveling agent, an antioxidant, and the like. Suitable materials for the charge generation material in the single-layered photosensitive layer 33 include the above-described materials suitable for the charge generation material in the charge generation layer 35.

Suitable materials for the binder resin in the single-layered photosensitive layer 33 include the above-described materials suitable for the binder resin in the charge generation layer 35 and the charge transport layer 37. In addition, the charge transport polymers described above are also preferable for the single-layered photosensitive layer 33. The content of the charge generation material is preferably from 5 to 40 parts by weight, and the content of the charge transport material is preferably from 0 to 190 parts by weight, and more preferably from 50 to 150 parts by weight, per 100 parts by weight of the binder resin included in the layer.

The single-layered photosensitive layer 33 may be prepared by applying a coating liquid, which may be prepared by dissolving or dispersing a charge generation material, a binder resin, and optionally together with a charge transport material in a solvent such as tetrahydrofuran, dioxane, dichloroethane, and cyclohexane, using a dispersing machine. Suitable coating methods include a dip coating method, a spray coating method, a bead coating method, a ring coating method, and the like. The photosensitive layer 33 preferably has a thickness of from 5 to 25 μm.

The photoreceptor of the present invention may include an undercoat layer between the conductive substrate 31 and the photosensitive layer 33. The undercoat layer typically includes a resin as a main component. Since the photosensitive layer 33 is typically formed on the undercoat layer by a wet coating method, the undercoat layer preferably has good resistance to the solvent included in the coating liquid of the photosensitive layer 33. Suitable resins for use in the undercoat layer include, but are not limited to, water-soluble resins such as polyvinyl alcohol, casein, and sodium polyacrylate; alcohol-soluble resins such as copolymer nylon and methoxymethylated nylon; and cured resins which form a three-dimensional network structure such as polyurethane, melamine resins, phenol resins, alkyd-melamine resins, and epoxy resins.

In addition, to prevent the occurrence of moiré and to decrease residual potential, the undercoat layer may include fine powders of metal oxides such as titanium oxide, silica, alumina, zirconium oxide, tin oxide, and indium oxide.

The undercoat layer may be prepared by a typical coating method using a proper solvent, in the same way as the preparation of the photosensitive layer 33. In addition, a metal oxide layer prepared by a sol-gel method using a silane coupling agent, a titan coupling agent, or a chrome coupling agent, may also be used as the undercoat layer. Furthermore, $Al_2O_3$ prepared by anodic oxidization; and thin films of organic materials such as polyparaxylylene (parylene) and inorganic materials such as $SiO_2$, $SnO_2$, $TiO_2$, ITO, and $CeO_2$ prepared by a vacuum method may also be used as the undercoat layer. The undercoat layer preferably has a thickness of from 0 to 5 μm.

The protective layer 39 may be optionally formed on the photosensitive layer to protect the photosensitive layer 33. Specific preferred examples of suitable binder resins used for the protective layer 39 include ABS resins, ACS resins, olefin-vinyl monomer copolymers, chlorinated polyether, aryl resins, phenol resins, polyacetal, polyamide, polyamideimide, polyacrylate, polyallylsulfone, polybutylene, polybutylene terephthalate, polycarbonate, polyether sulfone, polyethylene, polyethylene terephthalate, polyimide, acrylic resins, polymethylpentene, polypropylene, polyphenylene oxide, polysulfone, polystyrene, polyarylate, AS resins, butadiene-styrene copolymers, polyurethane, polyvinyl chloride, polyvinylidene chloride, and epoxy resins. Among these resins, polycarbonate and polyarylate are preferable from the viewpoint of dispersibility of a filler, residual potential, and coating defect.

The protective layer 39 further includes a filler to improve abrasion resistance.

Specific preferred examples of suitable solvents for forming the protective layer 39 include, but are not limited to, tetrahydrofuran, dioxane, toluene, dichloromethane, monochlorobenzene, dichloroethane, cyclohexanone, methyl ethyl ketone, and acetone. These suitable solvents are identical to those suitable for forming the charge transport layer 37. A high-viscosity solvent is preferable in view of dispersion efficiency of a coating liquid, whereas a highly-volatile solvent is preferable in view of coating reliability. If there is no solvent having both high viscosity and high volatile, 2 or more solvents can be used in combination. Solvents may have a large effect on dispersibility of fillers and residual potential.

Further, the protective layer 39 may optionally include the diamine compound having the formula (1). Moreover, the above-described low-molecular-weight charge transport materials and charge transport polymers preferable for the charge transport layer 37 may be added to the protective layer 39 to reduce residual potential and to improve image quality.

The protective layer 39 may be formed by typical coating methods such as a dip coating method, a spray coating method, a bead coating method, a nozzle coating method, a spinner coating method, and a ring coating method. Among these methods, a spray coating method is preferable from the viewpoint of uniform coating.

The photoreceptor of the present invention may optionally include an intermediate layer between the photosensitive layer 33 and the protective layer 39. The intermediate layer typically includes a binder resin as a main component. Specific preferred examples of suitable binder resins include, but are not limited to, polyamide, alcohol-soluble nylon, water-soluble polyvinyl butyral, polyvinyl butyral, and polyvinyl alcohol. The intermediate layer may be formed by a typical coating method as described above. The intermediate layer preferably has a thickness of from 0.05 to 2 μm.

The charge generation layer, charge transport layer, photosensitive layer, undercoat layer, protective layer, and intermediate layer each may optionally include an antioxidant, a plasticizer, a lubricant, an ultraviolet absorber, and/or a leveling agent for the purpose of improving environmental stability and preventing deterioration of sensitivity and increase of residual potential.

Specific examples of suitable antioxidants include the following compounds, but are not limited thereto.

(a) Phenol Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocopherols, etc.

(b) Paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur Compounds dilauryl-3,3'-thiodipropionate, distearyl-3,3'-thiodipropionate, ditetradecyl-3,3'-thiodipropionate, etc.

(e) Organic Phosphor Compounds triphenylphosphine, tri(nonylphenyl)phosphine, tri(dinonylphenyl)phosphine, tricresylphosphine, tri(2,4-dibutylohenoxy)phosphine, etc.

Specific examples of suitable plasticizers include the following compounds, but are not limited thereto.

(a) Phosphate Plasticizers triphenyl phosphate, tricresyl phosphate, trioctyl phosphate, octyl diphenyl phosphate, trichloroethyl phosphate, cresyl diphenyl phosphate, tributyl phosphate, tri-2-ethylhexyl phosphate, triphenyl phosphate, etc.

(b) Phthalate Plasticizers dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleylphthalate, octyl decylphthalate, dibutylphthalate, dioctyl phthalate, etc.

(c) Aromatic Carboxylate Plasticizers trioctyl trimellitate, tri-n-octyl trimellitate, octyl oxybenzoate, etc.

(d) Dibasic Esters of Aliphatic Series dibutyl adipate, di-n-hexyl adipate, di-2-ethylhexyl adipate, n-octyl adipate, n-octyl-n-decyl adipate, diisodecyl adipate, dicapryl adipate, di-2-ethylhexylazelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, etc.

(e) Fatty Acid Ester Derivatives butyl oleate, glycerin monooleate, methyl acetylricinolate, pentaerythritol esters, dipentaerythritol hexaesters, triacetin, tributyrin, etc.

(f) Oxyacid Ester Plasticizers methyl acetylricinolate, butyl acetylricinolate, butyl phthalyl butyl glycolate, tributyl acetylcitrate, etc.

(g) Epoxy Plasticizers epoxidized soybean oil, epoxidized linseed oil, butyl epoxystearate, decyl epoxystearate, octyl epoxystearate, benzyl epoxystearate, dioctyl epoxyhexahydrophthalate, didecyl epoxyhexahydrophthalate, etc.

(h) Divalent Alcohol Ester Plasticizers
diethylene glycol dibenzoate, triethylene glycol di-2-ethylbutyrate, etc.
(i) Chlorine-Containing Plasticizers
chlorinated paraffin, chlorinated diphenyl, methyl esters of chlorinated fatty acids, methyl esters of methoxychlorinated fatty acids, etc.
(j) Polyester Plasticizers
polypropylene adipate, polypropylene sebacate, polyester, acetylated polyester, etc.
(k) Sulfonic Acid Derivatives
p-toluene sulfonamide, o-toluene sulfonamide, p-toluene sulfonethylamide, o-toluene sulfonethylamide, toluenesulfon-N-ethylamide, p-toluenesulfon-N-cyclohexylamide, etc.
(l) Citric Acid Derivatives
triethyl citrate, triethyl acetylcitrate, tributyl citrate, tributyl acetylcitrate, tri-2-ethylhexyl acetylcitrate, n-octyldecyl acetylcitrate, etc.
(m) Others
terphenyl, partially hydrated terphenyl, camphor, 2-nitrodiphenyl, dinonyl naphthalene, methyl abietate, etc.

Specific examples of suitable lubricants include the following compounds, but are not limited thereto.
(a) Hydrocarbon Compounds
liquid paraffin, paraffin wax, micro wax, low-polymerization polyethylene, etc.
(b) Fatty Acid Compounds
lauric acid, myristic acid, palmitic acid, stearic acid, arachidic acid, behenic acid, etc.
(c) Fatty Acid Amide Compounds
stearyl amide, palmitic acid amide, oleic acid amide, methylenebis stearamide, ethylenebis stearamide, etc.
(d) Ester Compounds
lower alcohol esters of fatty acids, polyol esters of fatty acids, polyglycol esters of fatty acids, etc.
(e) Alcohol Compounds
cetyl alcohol, stearyl alcohol, ethylene glycol, polyethylene glycol, polyglycerol, etc.
(f) Metallic Soaps
lead stearate, cadmium stearate, barium stearate, calcium stearate, zinc stearate, magnesium stearate, etc.
(g) Natural Waxes
carnauba wax, candelilla wax, beeswax, spermaceti, insect wax, montan wax, etc.
(h) Others
silicone compounds, fluorine compounds, etc.

Specific examples of suitable ultraviolet absorbers include the following compounds, but are not limited thereto.
(a) Benzophenones
2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, etc.
(b) Salicylates
phenyl salicylate, 2,4-di-t-butylphenyl-3,5-di-t-butyl-4-hydroxybenzoate, etc.
(c) Benzotriazoles
(2'-hydroxyphenyl)benzotriazole, (2'-hydroxy-5'-methylphenyl)benzotriazole, (2'-hydroxy-3'-tert-butyl-5'-methylphenyl)5-chlorobenzotriazole, etc.
(d) Cyanoacrylates
ethyl-2-cyano-3,3-diphenyl acrylate, methyl-2-carbomethoxy-3(paramethoxy) acrylate, etc.
(e) Quenchers (Metal Complexes)
nickel(2,2'-thiobis(4-t-octyl)phenolate)n-butylamine, nickel dibutyldithiocarbamate, cobalt dicyclohexyldithiophosphate, etc.
(f) HALS (Hindered Amines)
bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, etc.

Next, exemplary embodiments of the image forming method and the image forming apparatus of the present invention are described in detail below.

Figure 6:
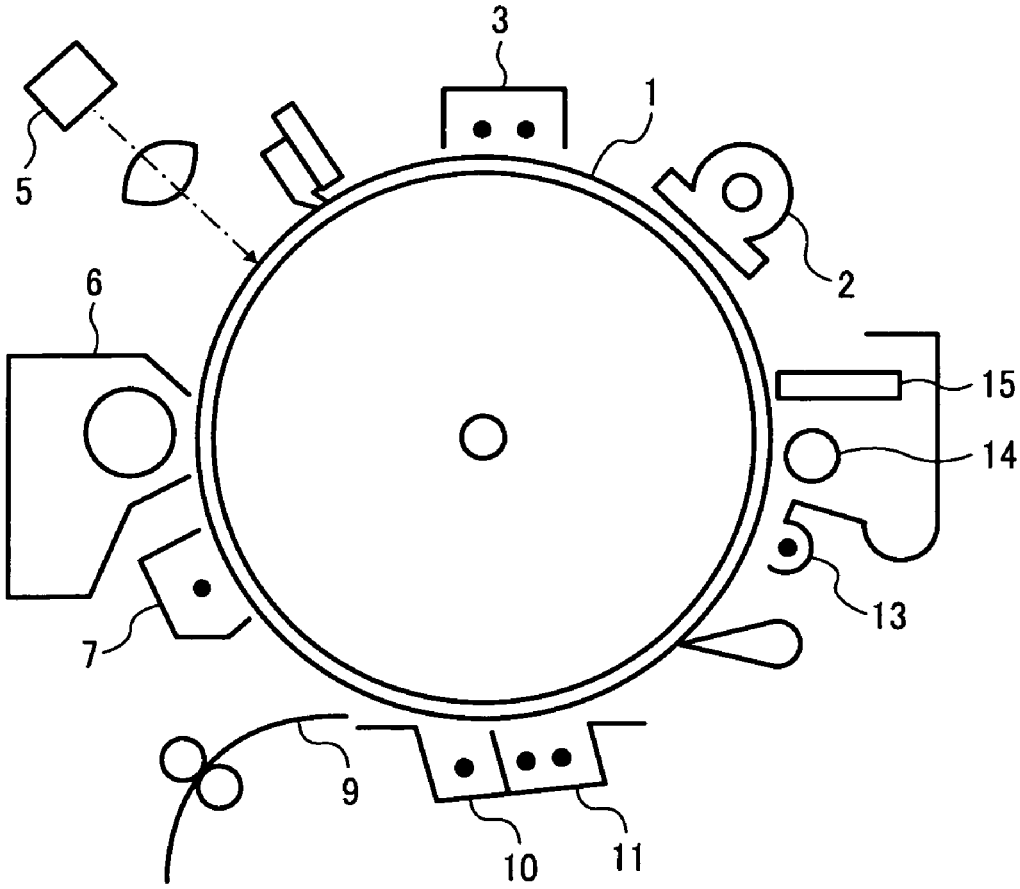
FIG. 6 is a schematic view illustrating an embodiment of the image forming apparatus of the present invention, which is an electrophotographic apparatus.

FIG. 6 is a schematic view illustrating an embodiment of the image forming apparatus of the present invention, which is an electrophotographic apparatus. An embodiment of the image forming method of the present invention, which is an electrophotographic method, is described below with reference to FIG. 6.

A photoreceptor 1 includes a photosensitive layer, and the outermost layer thereof includes a filler. The photoreceptor 1 has a drum-like shape in FIG. 6, however, the photoreceptor may have a sheet-like shape or an endless-belt-like shape. Each of a charger 3, a pre-transfer charger 7, a transfer charger 10, a separation charger 11, and a pre-cleaning charger 13, may be chargers such as a corotron, a scorotron, a solid state charger, a charging roller, for example.

A transfer device may also be the above-described chargers, for example. As illustrated in FIG. 6, the transfer device is preferably composed of both the transfer charger 10 and the separation charger 11.

Suitable light sources for an irradiator 5 and a decharging lamp 2 include illuminants such as fluorescent lamps, tungsten lamps, halogen lamps, mercury lamps, sodium lamps, light-emitting diodes (LED), laser diodes (LD), and electroluminescences (EL). In order to obtain light having a desired wave length range, filters such as sharp-cut filters, band pass filters, near-infrared cutting filters, dichroic filters, interference filters, color temperature converting filters, and the like, can be used.

In a case in which a transfer process, a decharging process, and/or a cleaning process are performed along with light irradiation, or a pre-irradiation process is provided, the photoreceptor 1 may be irradiated with light emitted from the above-described light sources.

A toner image formed on the photoreceptor 1 by a developing unit 6 is subsequently transferred onto a transfer paper 9. Some toner particles may remain on the photoreceptor 1 without being transferred onto the transfer paper 9. Such residual toner particles are removed using a fur brush 14 and a blade 15. Alternatively, removal of residual toner particles may be performed using only a cleaning brush such as the fur brush 14. The cleaning brush may be a fur brush and a magnet fur brush, for example.

When an electrophotographic photoreceptor is positively (negatively) charged and irradiated with light, a positive (negative) electrostatic latent image is formed thereon. When the positive (negative) electrostatic latent image is developed with a negatively (positively) chargeable toner, a positive image is produced. By contrast, when the positive (negative) electrostatic latent image is developed with a positively (negatively) chargeable toner, a negative image is produced.

The developing unit 6 and the decharging lamp 2 are not limited to any particular embodiment.

Figure 7:
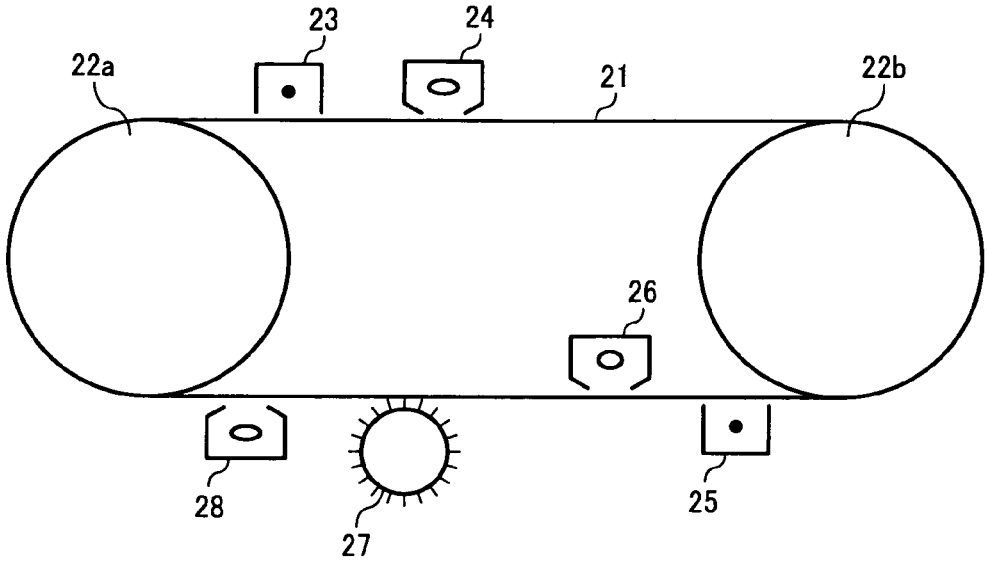
FIG. 7 is a schematic view illustrating another embodiment of an image forming apparatus of the present invention, which is an electrophotographic apparatus.

FIG. 7 is a schematic view illustrating another embodiment of an image forming apparatus of the present invention, which is an electrophotographic apparatus. Another embodiment of the image forming method of the present invention, which is an electrophotographic method, is described below with reference to FIG. 7.

A photoreceptor 21 includes a photosensitive layer, and the outermost layer thereof includes a filler. The photoreceptor 21 is driven by driving rollers 22*a* and 22*b*, charged by a charger 23, and irradiated with a light beam emitted from an image irradiator 24. A toner image is formed on the photoreceptor 21 by a developing device, not shown, and transferred onto a transfer paper, not shown, by a transfer charger 25. The photoreceptor 21 is then irradiated with a light beam emitted from a pre-cleaning irradiator 26, cleaned by a brush 27, and decharged by a decharging irradiator 28. The above-described operation is repeatedly performed. As illustrated in FIG. 7, the pre-cleaning irradiator 26 irradiates the photoreceptor 21 from a side on which the substrate is provided. In this case, of course, the substrate is translucent.

Alternatively, the pre-cleaning irradiator 26 may irradiate the photoreceptor 21 from a side on which the photosensitive layer is provided, and each of the image irradiator 24 and the decharging irradiator 28 may irradiate the photoreceptor 21 from a side on which a substrate is provided.

Further, in addition to the image irradiation process, the pre-cleaning irradiation process, and the decharging irradiation process, the photoreceptor 21 may be also subjected to irradiation preliminary to the transfer process or in the image irradiation process.

Figure 8:
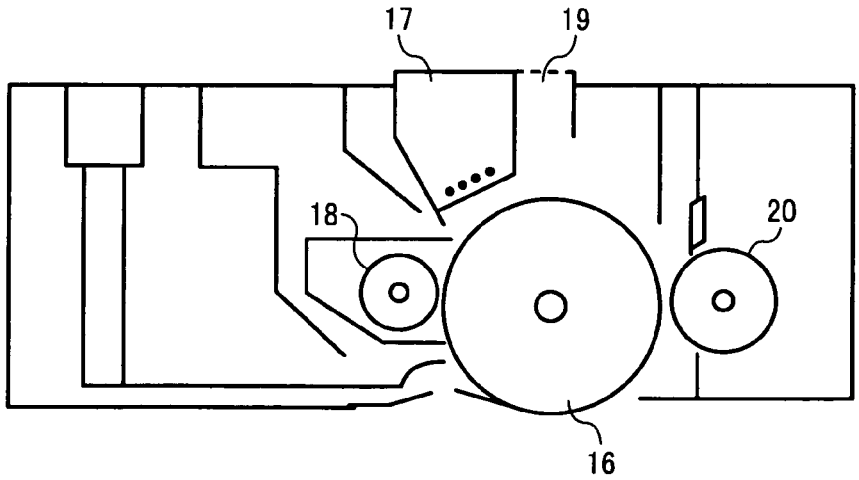
FIG. 8 is a schematic view illustrating an embodiment of the process cartridge of the present invention.

The above-described image forming devices may be fixedly mounted on an image forming apparatus such as a copier, a facsimile, and a printer. Alternatively, the above-described image forming devices may be integrally combined as a process cartridge. A typical process cartridge is a single device (i.e., component) including a photoreceptor, a charger, an irradiator, a developing device, a transfer device, a cleaning device, and a decharging device. FIG. 8 is a schematic view illustrating an embodiment of the process cartridge of the present invention, including a photoreceptor 16 which is the photoreceptor of the present invention, a charger 17, a cleaning brush 18, an image irradiator 19, and a developing roller 20. The photoreceptor 16 comprises a conductive substrate and a photosensitive layer formed on the conductive substrate, and the outermost layer thereof may include a filler.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

Synthesis of Compound No. 23

A mixture of 8.08 g (18.0 mmol) of a diamine compound having the following formula (1), 7.18 g (39.6 mmol) of benzylideneaniline, 20.2 g (180 mmol) of potassium tert-butoxide, and 75 ml of N,N-dimethylformamide (i.e., DMF) was agitated for 2 hours at an inner temperature of 75° C. under an argon gas stream.

(I)

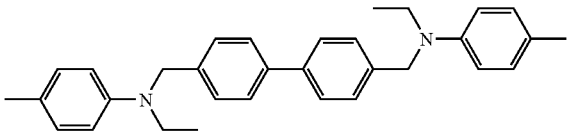

Subsequently, the mixture was cooled to room temperature and poured into 300 ml of water, followed by agitation for 30 minutes. As a result, a yellow powder was deposited. The deposited yellow powder was collected by filtration, washed with water twice, and washed with methanol twice. The yellow powder was then heated under reduced pressure to dry. Thus, 9.15 g of a light-yellow powdery compound having the following formula (II), which was the compound No. 23 described in Table 2, were obtained. The yield was 81.4%.

(II)

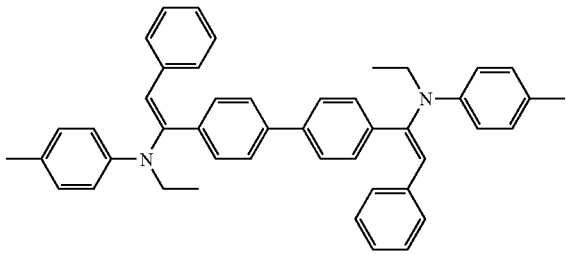

Figure 9:
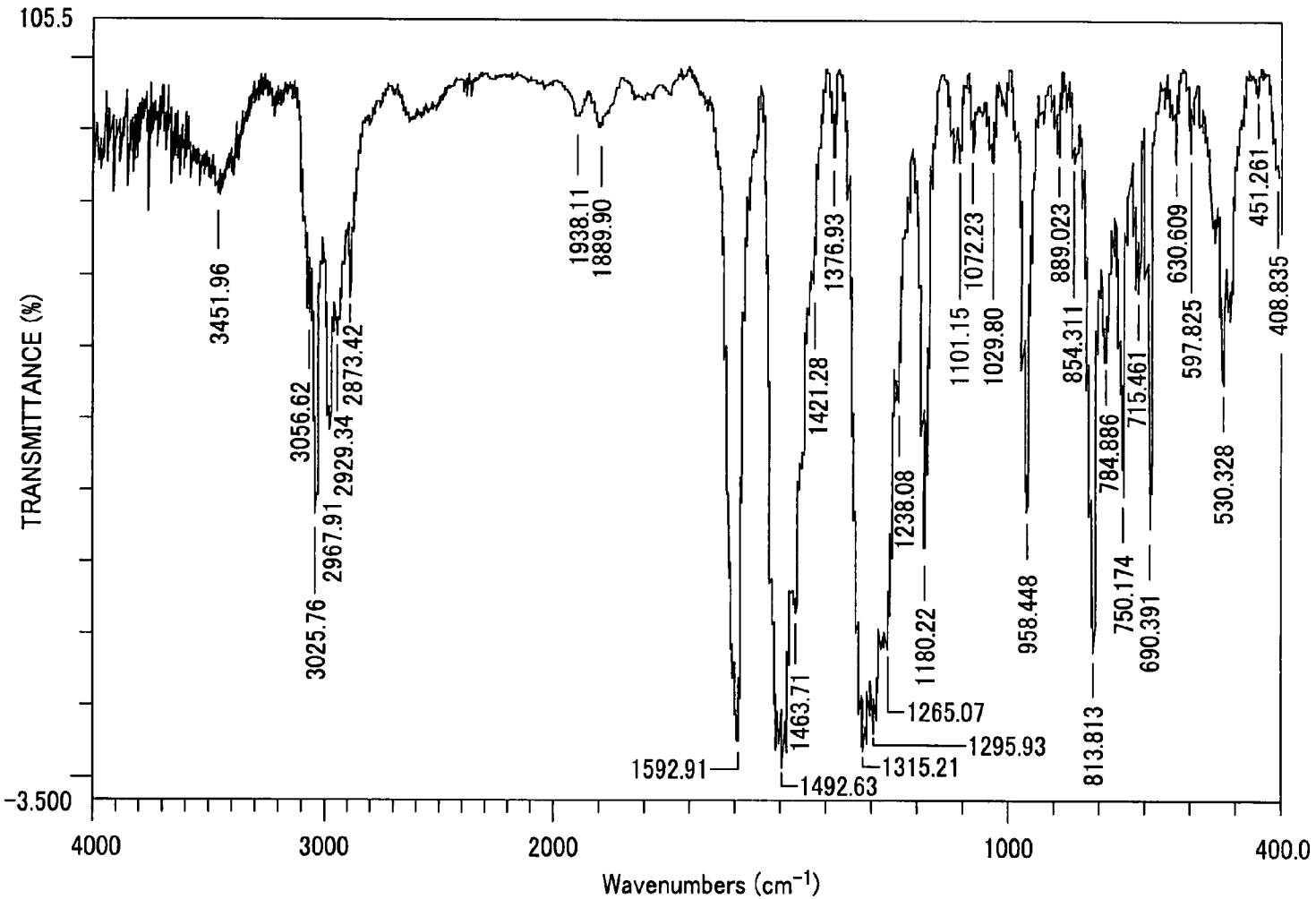
FIG. 9 is an infrared absorption spectrum of an exemplary diamine compound.

The resultant compound (II) had a melting point of from 149.5 to 153.0° C. As a result of an LC-MS analysis of the compound (II), a peak of 625.30 that corresponds to a molecular ion ($[M+H]^+$) in which a proton is added to the diamine compound No. 23 (having a calculated molecular weight of 624.3) was observed. An infrared absorption spectrum (obtained by a KBr pellet method) of the resultant compound having the formula (II) was illustrated in FIG. 9.

Example 1

An undercoat layer coating liquid, a charge generation layer coating liquid, and a charge transport layer coating liquid, each having the following compositions, were successively applied to an aluminum cylinder and dried, in this order. Thus, a photoreceptor No. 1 including an undercoat layer having a thickness of 3.5 μm, a charge generation layer having a thickness of 0.2 μm, and a Charge transport layer having a thickness of 20 μm was prepared.

(Composition of Undercoat Layer Coating Liquid)

| | |
|---|---|
| Titanium dioxide powder | 400 parts |
| Melamine resin | 65 parts |
| Alkyd resin | 120 parts |
| 2-Butanone | 400 parts |

(Composition of Charge Generation Layer Coating Liquid)

| | |
|---|---|
| Fluorenone bisazo pigment (46) | 12 parts |
| Polyvinyl butyral | 5 parts |
| 2-Butanone | 200 parts |
| Cyclohexanone | 400 parts |

(46)

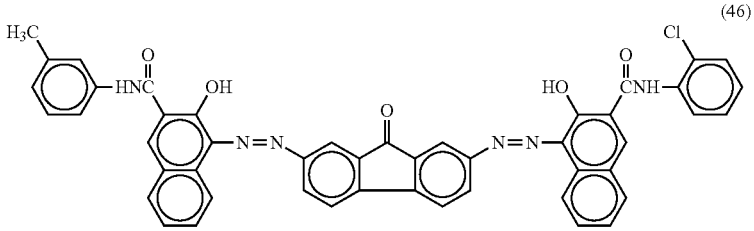

(Composition of Charge Transport Layer Coating Liquid)

| | |
|---|---|
| Polycarbonate Resin (Z-form polycarbonate resin from Teijin Chemicals Ltd.) | 10 parts |
| Diamine compound No. 7 | 10 parts |
| Tetrahydrofuran | 100 parts |

The above-prepared photoreceptor No. 1 was mounted on a process cartridge, and the process cartridge was mounted on a modified image forming apparatus IMAGIO MP2550 (manufactured and modified by Ricoh Co., Ltd.) in which the charging method was a scorotron corona charging method and the light source for image irradiation was a laser diode (LD) having a wavelength of 655 nm. The dark section potential was set to 800 (−V). A running test in which 100,000 sheets of an image were continuously produced was performed. At the beginning of and after the running test, the produced image was evaluated and the bright section potential was measured. The evaluation results are shown in Table 4.

Examples 2 to 15

The procedure in Example 1 was repeated except for replacing the diamine compound No. 7 with another diamine compound as described in Table 4. Thus, photoreceptors 2 to 15 were prepared. The evaluation results are shown in Table 4.

TABLE 4

| | | | Initial stage | | After printing 100,000 sheets | |
|---|---|---|---|---|---|---|
| Ex. | Photo-receptor No. | Diamine Compound No. | Bright Section Potential (−V) | Image Quality | Bright Section Potential (−V) | Image Quality |
| 1 | 1 | 7 | 55 | Good | 75 | Good |
| 2 | 2 | 2 | 60 | Good | 85 | Good |
| 3 | 3 | 3 | 50 | Good | 90 | Good |
| 4 | 4 | 4 | 45 | Good | 70 | Good |
| 5 | 5 | 6 | 45 | Good | 75 | Good |
| 6 | 6 | 11 | 55 | Good | 85 | Good |
| 7 | 7 | 14 | 55 | Good | 80 | Good |
| 8 | 8 | 16 | 75 | Good | 105 | Image density decreased slightly. |
| 9 | 9 | 17 | 50 | Good | 70 | Good |
| 10 | 10 | 21 | 70 | Good | 105 | Image density decreased slightly. |
| 11 | 11 | 23 | 50 | Good | 115 | Image density decreased slightly. |
| 12 | 12 | 26 | 65 | Good | 90 | Good |
| 13 | 13 | 29 | 55 | Good | 110 | Image density decreased slightly. |
| 14 | 14 | 31 | 70 | Good | 80 | Good |
| 15 | 15 | 41 | 50 | Good | 85 | Good |

Example 16

The procedure in Example 1 was repeated except for replacing the charge transport layer coating liquid with another charge transport layer coating liquid having the following composition:

| | |
|---|---|
| Polycarbonate resin (Z-form polycarbonate resin from Teijin Chemicals Ltd.) | 10 parts |
| Diamine compound No. 7 | 1 part |
| Charge transport material (47) | 9 parts |
| Tetrahydrofuran | 100 parts |

(47)

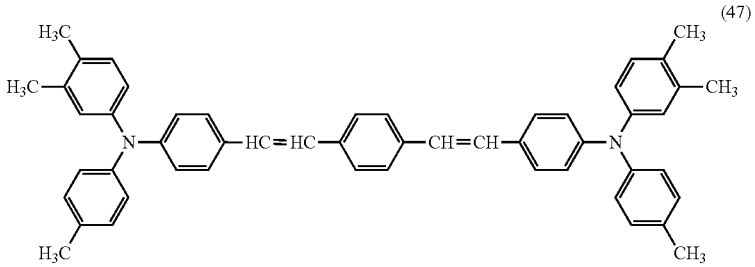

Thus, a photoreceptor 16 was prepared. The evaluation results are shown in Table 5.

Examples 17 to 30

The procedure in Example 16 was repeated except for replacing the diamine compound No. 7 with another diamine compound as described in Table 5. Thus, photoreceptors 17 to 30 were prepared. The evaluation results are shown in Table 5.

TABLE 5

| | | | Initial stage | | After printing 100,000 sheets | |
|---|---|---|---|---|---|---|
| Ex. | Photo-receptor No. | Diamine Compound No. | Bright Section Potential (−V) | Image Quality | Bright Section Potential (−V) | Image Quality |
| 16 | 16 | 7 | 45 | Good | 55 | Good |
| 17 | 17 | 2 | 50 | Good | 60 | Good |
| 18 | 18 | 3 | 50 | Good | 55 | Good |
| 19 | 19 | 4 | 45 | Good | 55 | Good |
| 20 | 20 | 6 | 50 | Good | 60 | Good |
| 21 | 21 | 11 | 50 | Good | 60 | Good |
| 22 | 22 | 14 | 50 | Good | 65 | Good |
| 23 | 23 | 16 | 50 | Good | 55 | Good |
| 24 | 24 | 17 | 50 | Good | 60 | Good |
| 25 | 25 | 21 | 55 | Good | 60 | Good |
| 26 | 26 | 23 | 50 | Good | 55 | Good |
| 27 | 27 | 26 | 65 | Good | 65 | Good |
| 28 | 28 | 29 | 50 | Good | 65 | Good |
| 29 | 29 | 31 | 55 | Good | 60 | Good |
| 30 | 30 | 41 | 60 | Good | 65 | Good |

Examples 31 to 34

The procedure in Example 16 was repeated except that that the diamine compound No. 7 was replaced with another diamine compound as described in Table 6, and the amounts of the diamine compound and the charge transport material were changed to 1 part and 7 parts, respectively. Thus, photoreceptors 31 to 34 were prepared. The evaluation results are shown in Table 6.

TABLE 6

| | | | Initial stage | | After printing 100,000 sheets | |
|---|---|---|---|---|---|---|
| Ex. | Photo-receptor No. | Diamine Compound No. | Section Potential (−V) | Image Quality | Section Potential (−V) | Image Quality |
| 31 | 31 | 4 | 50 | Good | 55 | Good |
| 32 | 32 | 17 | 50 | Good | 55 | Good |
| 33 | 33 | 25 | 55 | Good | 65 | Good |
| 34 | 34 | 37 | 55 | Good | 60 | Good |

Examples 35 to 38

The procedure in Example 16 was repeated except that that the diamine compound No. 7 was replaced with another diamine compound as described in Table 7, and the amounts of the diamine compound and the charge transport material were changed to 5 parts and 5 parts, respectively. Thus, photoreceptors 35 to 38 were prepared. The evaluation results are shown in Table 7.

TABLE 7

| | | | Initial stage | | After printing 100,000 sheets | |
|---|---|---|---|---|---|---|
| Ex. | Photo-receptor No. | Diamine Compound No. | Bright Section Potential (−V) | Image Quality | Bright Section Potential (−V) | Image Quality |
| 35 | 35 | 4 | 50 | Good | 55 | Good |
| 36 | 36 | 17 | 55 | Good | 60 | Good |
| 37 | 37 | 25 | 60 | Good | 85 | Good |
| 38 | 38 | 37 | 70 | Good | 70 | Good |

Examples 39 to 42

The procedure in Example 16 was repeated except that that the diamine compound No. 7 was replaced with another diamine compound as described in Table 8, and the charge transport material (47) was replaced with another charge transport material (48). Thus, photoreceptors 39 to 42 were prepared. The evaluation results are shown in Table 8.

(48)

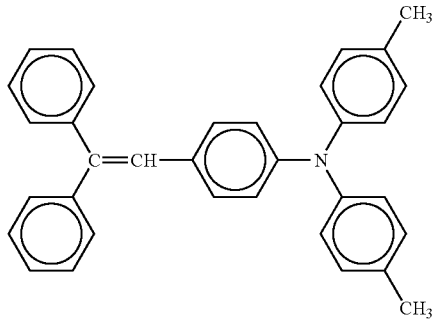

TABLE 8

| Ex. | Photo-receptor No. | Diamine Compound No. | Initial stage Bright Section Potential (−V) | Initial stage Image Quality | After printing 100,000 sheets Bright Section Potential (−V) | After printing 100,000 sheets Image Quality |
|---|---|---|---|---|---|---|
| 39 | 39 | 4 | 50 | Good | 60 | Good |
| 40 | 40 | 17 | 50 | Good | 55 | Good |
| 41 | 41 | 25 | 55 | Good | 75 | Good |
| 42 | 42 | 37 | 60 | Good | 65 | Good |

Examples 43 to 46

The procedure in Example 16 was repeated except that that the diamine compound No. 7 was replaced with another diamine compound as described in Table 9, and the charge transport material (47) was replaced with another charge transport material (49). Thus, photoreceptors 43 to 46 were prepared. The evaluation results are shown in Table 9.

(49)

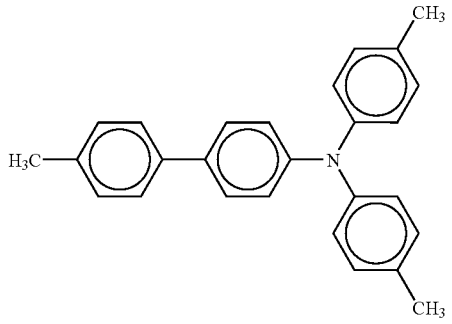

TABLE 9

| Ex. | Photo-receptor No. | Diamine Compound No. | Initial stage Bright Section Potential (−V) | Initial stage Image Quality | After printing 100,000 sheets Bright Section Potential (−V) | After printing 100,000 sheets Image Quality |
|---|---|---|---|---|---|---|
| 43 | 43 | 4 | 50 | Good | 65 | Good |
| 44 | 44 | 17 | 55 | Good | 65 | Good |
| 45 | 45 | 25 | 60 | Good | 80 | Good |
| 46 | 46 | 37 | 55 | Good | 70 | Good |

Examples 47 to 49

The procedure in Example 16 was repeated except that that the diamine compound No. 7 was replaced with another diamine compound as described in Table 10, and the charge transport material and the binder resin in the charge transport layer were replaced with 19 parts of a charge transport polymer (50). Thus, photoreceptors 47 to 49 were prepared. The evaluation results are shown in Table 10.

(50)

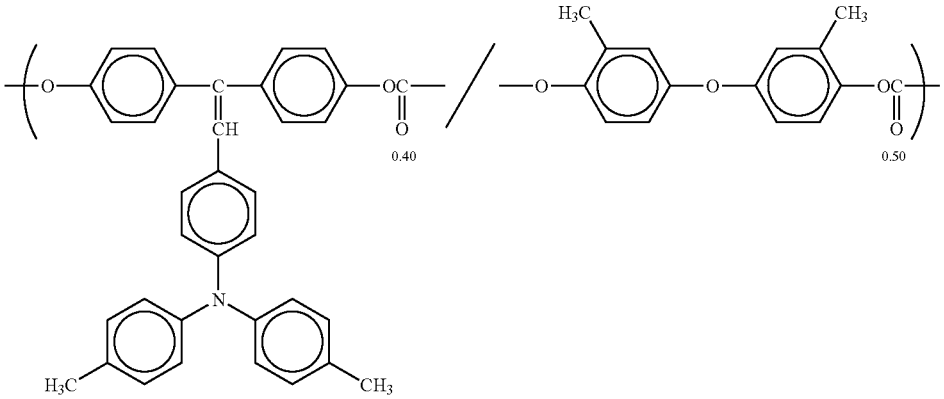

TABLE 10

| Ex. | Photo-receptor No. | Diamine Compound No. | Initial stage Bright Section Potential (−V) | Initial stage Image Quality | After printing 100,000 sheets Bright Section Potential (−V) | After printing 100,000 sheets Image Quality |
|---|---|---|---|---|---|---|
| 47 | 47 | 3 | 45 | Good | 70 | Good |
| 48 | 48 | 8 | 50 | Good | 75 | Good |
| 49 | 49 | 17 | 45 | Good | 65 | Good |
| 50 | 50 | 4 | 50 | Good | 75 | Good |
| 51 | 51 | 17 | 50 | Good | 70 | Good |

Examples 50 and 51

The procedure in Example 16 was repeated except that that the diamine compound No. 7 was replaced with another diamine compound as described in Table 11, and the charge transport material and the binder resin in the charge transport layer were replaced with 19 parts of a charge transport polymer (51). Thus, photoreceptors 50 and 51 were prepared. The evaluation results are shown in Table 11.

Examples 52 and 53

The procedure in Example 16 was repeated except that that the diamine compound No. 7 was replaced with another diamine compound as described in Table 12, and the charge transport material and the binder resin in the charge transport layer were replaced with 19 parts of a charge transport polymer (52). Thus, photoreceptors 52 and 53 were prepared. The evaluation results are shown in Table 12.

(51)

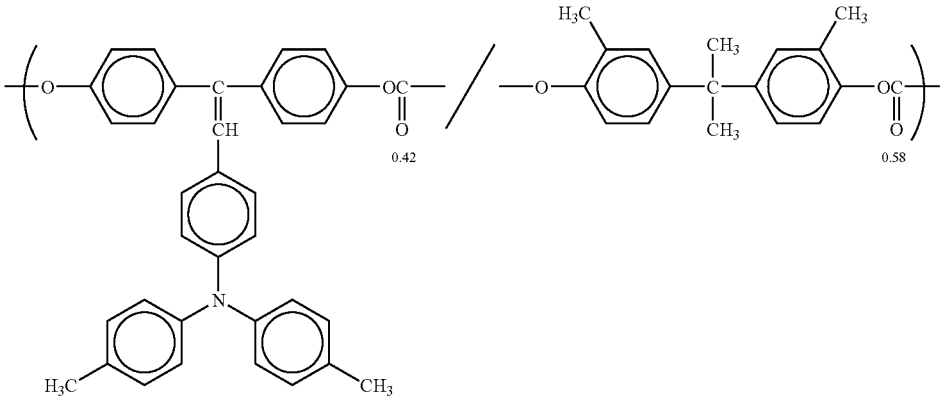

TABLE 11

(52)

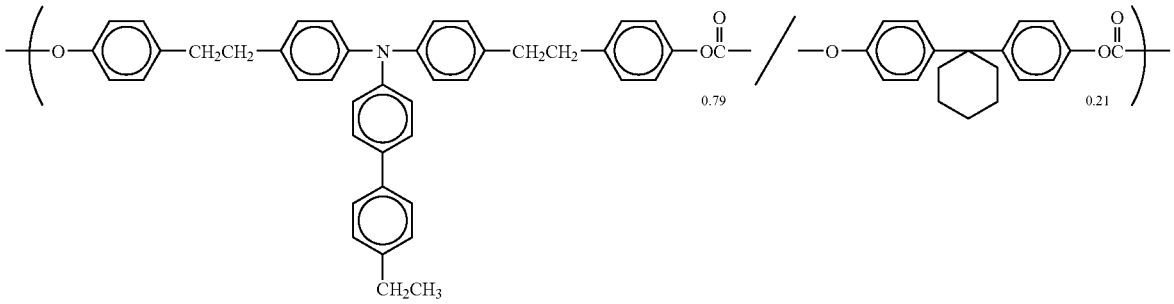

TABLE 12

| Ex. | Photo-receptor No. | Diamine Compound No. | Initial stage Bright Section Potential (−V) | Initial stage Image Quality | After printing 100,000 sheets Bright Section Potential (−V) | After printing 100,000 sheets Image Quality |
|---|---|---|---|---|---|---|
| 52 | 52 | 17 | 55 | Good | 85 | Good |
| 53 | 53 | 36 | 50 | Good | 70 | Good |

Examples 54 to 57

The procedure in Example 16 was repeated except that that the diamine compound No. 7 was replaced with another diamine compound as described in Table 13, and the binder resin was replaced with 10 parts of a polyarylate resin (U polymer from Unitika Ltd.). Thus, photoreceptors 54 to 57 were prepared. The evaluation results are shown in Table 13.

TABLE 13

| Ex. | Photo-receptor No. | Diamine Compound No. | Initial stage Bright Section Potential (−V) | Initial stage Image Quality | After printing 100,000 sheets Bright Section Potential (−V) | After printing 100,000 sheets Image Quality |
|---|---|---|---|---|---|---|
| 54 | 54 | 8 | 60 | Good | 75 | Good |
| 55 | 55 | 17 | 50 | Good | 55 | Good |
| 56 | 56 | 24 | 45 | Good | 65 | Good |
| 57 | 57 | 30 | 55 | Good | 75 | Good |

Examples 58 and 59

The procedure in Example 1 was repeated except that the charge generation layer coating liquid and the charge transport layer coating liquid were replaced with another charge generation layer coating liquid and another charge transport layer coating liquid, respectively, having the following compositions.

(Composition of Charge Generation Layer Coating Liquid)

Figure 10:
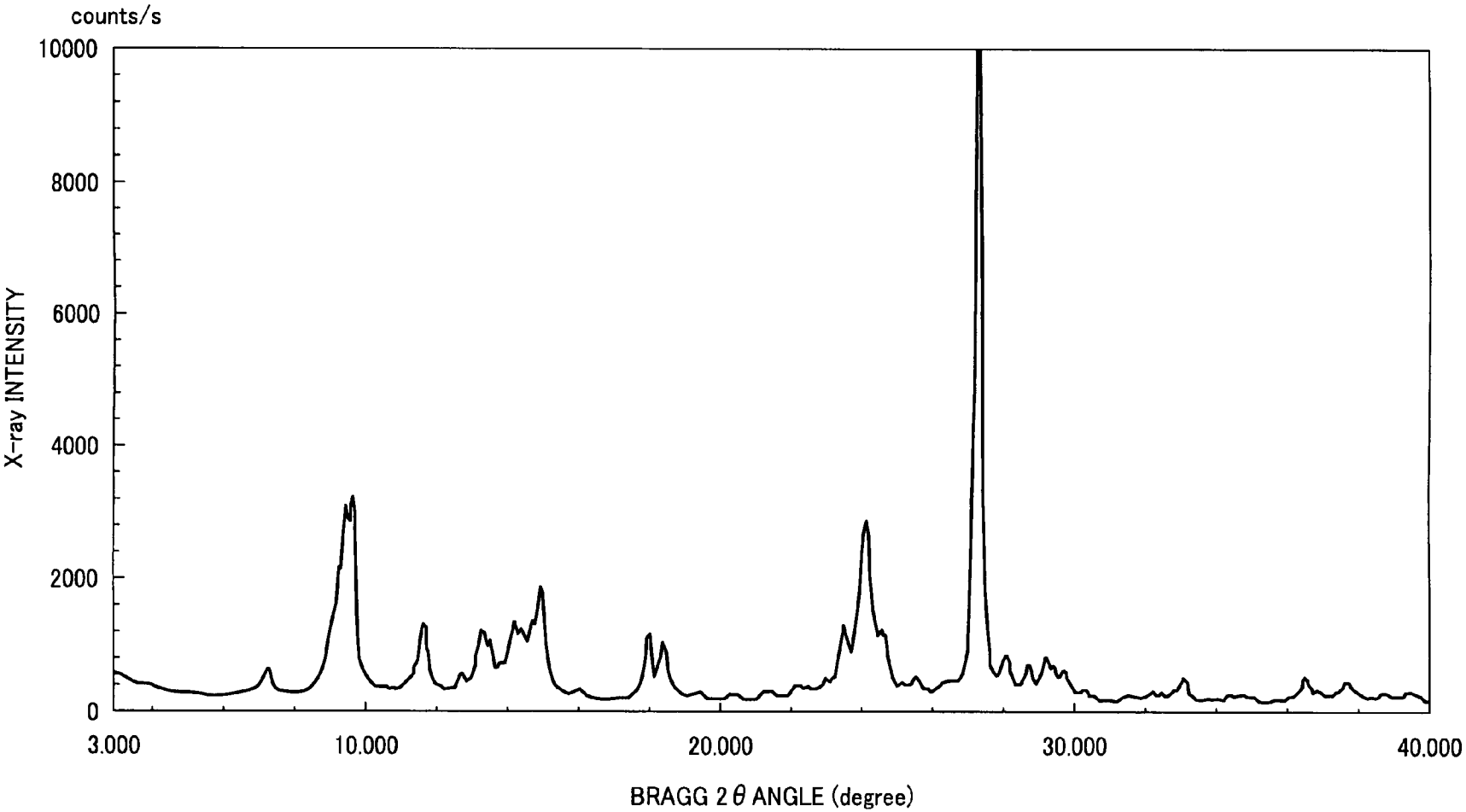
FIG. 10 is a powder XD spectrum of an oxo-titanium phthalocyanine.

| | |
|---|---|
| Oxo-titanium phthalocyanine having a powder XD spectrum illustrated in FIG. 10 | 12 parts |
| Polyvinyl butyral (BX-1) | 5 parts |
| 2-Butanone | 400 parts |

(Composition of Charge Transport Layer Coating Liquid)

| | |
|---|---|
| Polycarbonate resin (Z-form polycarbonate resin from Teijin Chemicals Ltd.) | 10 parts |
| Diamine compound | 1 part |
| Charge transport material (47) | 7 parts |
| Toluene | 70 parts |

(47)

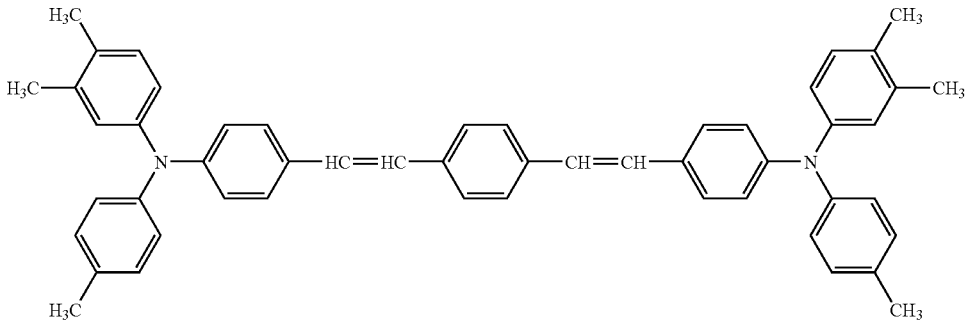

TABLE 14

| Ex. | Photo-receptor No. | Diamine Compound No. | Initial stage: Bright Section Potential (−V) | Initial stage: Image Quality | After printing 100,000 sheets: Bright Section Potential (−V) | After printing 100,000 sheets: Image Quality |
|---|---|---|---|---|---|---|
| 58 | 58 | 9 | 45 | Good | 50 | Good |
| 59 | 59 | 23 | 50 | Good | 55 | Good |

Examples 60 and 61

The procedure in Example 58 was repeated except that the charge transport material (47) was replaced with another charge transport material (48). Thus, photoreceptors 60 and 61 were prepared. The evaluation results are shown in Table 15.

(48)

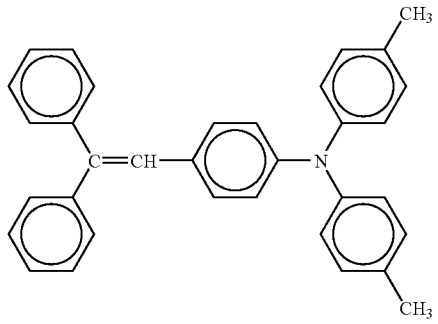

TABLE 15

| Ex. | Photo-receptor No. | Diamine Compound No. | Initial stage: Bright Section Potential (−V) | Initial stage: Image Quality | After printing 100,000 sheets: Bright Section Potential (−V) | After printing 100,000 sheets: Image Quality |
|---|---|---|---|---|---|---|
| 60 | 60 | 9 | 60 | Good | 75 | Good |
| 61 | 61 | 23 | 65 | Good | 80 | Good |

Comparative Example 1

The procedure in Example 16 was repeated except that the diamine compound No. 7 was replaced with a stilbene compound (54) (disclosed in JP-A 60-196768). Thus, a comparative photoreceptor 1 was prepared. The evaluation results are shown in Table 16.

(54)

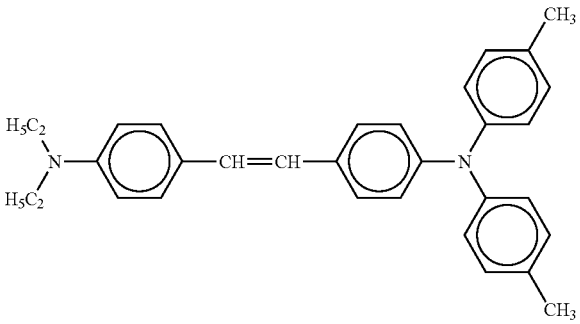

Comparative Example 2

The procedure in Example 16 was repeated except that no diamine compound was included in the charge transport layer coating liquid, and the amount of the charge transport material was changed to 10 parts. Thus, a comparative photoreceptor 2 was prepared. The evaluation results are shown in Table 16.

Comparative Example 3

The procedure in Example 35 was repeated except that the diamine compound No. 4 was replaced with a tetraphenylmethane compound (55) (disclosed in JP-A 2000-231204). Thus, a comparative photoreceptor 3 was prepared. The evaluation results are shown in Table 16.

(55)

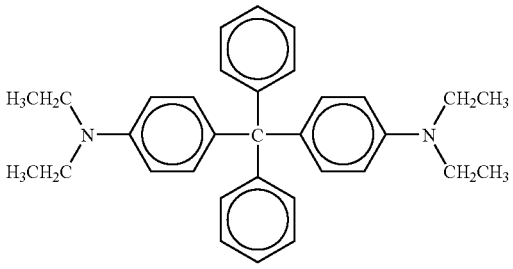

Comparative Example 4

The procedure in Example 16 was repeated except that the diamine compound No. 7 was replaced with a hindered amine antioxidant (56). Thus, a comparative photoreceptor 4 was prepared. The evaluation results are shown in Table 16.

(56)

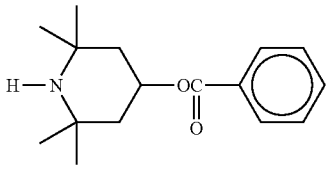

Comparative Example 5

The procedure in Example 16 was repeated except that the diamine compound No. 7 was replaced with another diamine compound (57) (disclosed in Japanese Patent No. 4101676). Thus, a comparative photoreceptor 5 was prepared. The evaluation results are shown in Table 16.

(57)

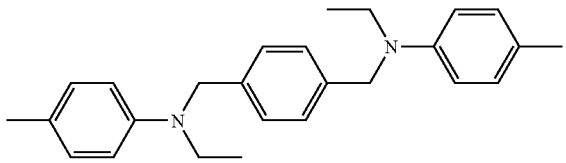

TABLE 16

| Ex. | Photo-receptor No. | Initial stage: Bright Section Potential (−V) | Initial stage: Image Quality | After printing 100,000 sheets: Bright Section Potential (−V) | After printing 100,000 sheets: Image Quality |
|---|---|---|---|---|---|
| Comp. 1 | Comp. 1 | 270 | Low image density | 500 | Image density decreased considerably. Impossible to determine resolution. |
| Comp. 2 | Comp. 2 | 50 | Good | 85 | Resolution decreased considerably. |
| Comp. 3 | Comp. 3 | 150 | Low image density/ Good resolution | 260 | Image density decreased. Resolution is good. |
| Comp. 4 | Comp. 4 | 170 | Low image density/ Low resolution | 420 | Image density decreased considerably. Impossible to determine resolution. |
| Comp. 5 | Comp. 5 | 60 | Good | 95 | Resolution decreased. |

It is apparent from the above results that photoreceptors including the diamine compounds having the formula (1) reliably produced high quality images without increase of the bright section potential even after 100,000 sheets of image were produced. By contrast, the comparative photoreceptors 1, 3, and 4 caused deterioration of image density and resolution because the bright section potential was kept high from the initial stage. Additionally, after printing 100,000 sheets, it was impossible to determine image resolution in the case of comparative photoreceptors 1 and 4 because gradation has considerably decreased. With regard to the comparative photoreceptors 2 and 5, the bright section potential increased only slightly, but resolution decreased considerably.

Examples 62 to 67 and Comparative Example 6

The photoreceptors and comparative photoreceptor described in Table 17 were left in a desiccator filled with 50 ppm of nitrogen oxide (NOx) gases for 4 days. Images produced before and after the photoreceptors have been left in the desiccator were evaluated. The evaluation results are shown in Table 17.

TABLE 17

| | Photoreceptor No. | Image Quality: Before | Image Quality: After |
|---|---|---|---|
| Example 62 | 1 | Good | Good |
| Example 63 | 19 | Good | Good |
| Example 64 | 28 | Good | Good |
| Example 65 | 41 | Good | Good |
| Example 66 | 45 | Good | Good |
| Example 67 | 49 | Good | Good |
| Example 68 | 51 | Good | Good |
| Example 69 | 52 | Good | Good |
| Example 70 | 57 | Good | Good |
| Example 71 | 59 | Good | Good |
| Example 72 | 61 | Good | Good |
| Comparative Example 6 | Comparative 2 | Good | Resolution decreased considerably. |

It is apparent from Table 17 that the photoreceptors of the present invention including the diamine compound having the formula (1) produced high-resolution image even after exposure to oxidizing gases, i.e., the photoreceptors of the present invention expressed good resistance to oxidizing gases. By contrast, the comparative photoreceptor 2 produced low-resolution image after exposure to oxidizing gases.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-287851, filed on Nov. 10, 2009, the entire contents of which are herein incorporated by reference.

What is claimed is:

1. An electrophotographic photoreceptor, comprising:

a conductive substrate; and a photosensitive layer located overlying the conductive substrate, wherein the photosensitive layer comprises a diamine compound having the following formula (1):

(1)

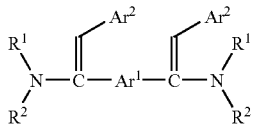

wherein each of $R^1$ and $R^2$ independently represents a substituted or unsubstituted alkyl group or an aromatic hydrocarbon group, or $R^1$ and $R^2$ may share bond connectivity to form a substituted or unsubstituted heterocyclic group containing a nitrogen atom; $Ar^1$ represents a substituted or unsubstituted divalent aromatic hydrocarbon group; and $Ar^2$ represents a substituted or unsubstituted monovalent aromatic hydrocarbon group.

2. The electrophotographic photoreceptor according to claim 1, wherein the photosensitive layer further comprises a charge transport material.

3. The electrophotographic photoreceptor according to claim 2, wherein the charge transport material is a stilbene compound having the following formula (2):

(2)

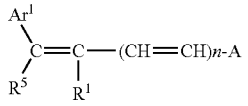

wherein n represents an integer of 0 or 1; $R^1$ represents an alkyl group or a substituted or unsubstituted phenyl group; $Ar^1$ represents a substituted or unsubstituted aromatic hydrocarbon group; $R^5$ represents an alkyl group having 1 to 4 carbon atoms or a substituted or unsubstituted aromatic hydrocarbon group; $Ar^1$ and $R^5$ may share bond connectivity to form a ring; and A represents a 9-anthryl group, a substituted or unsubstituted carbazolyl group, or a group having the following formula (3) or (4):

(3)

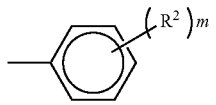

(4)

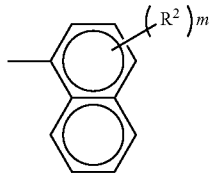

wherein $R^2$ represents a hydrogen atom, an alkyl group, an alkoxy group, a halogen atom, or a group having the following formula (5):

(5)

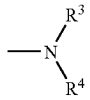

wherein each of $R^3$ and $R^4$ independently represents a substituted or unsubstituted aromatic hydrocarbon group, or $R^3$ and $R^4$ may share bond connectivity to form a ring; m represents an integer of from 1 to 3; when m is 2 or more, multiple $R^2$ may be, but need not necessarily be, the same; and when n is 0, A and $R^1$ may share bond connectivity to form a ring.

4. The electrophotographic photoreceptor according to claim 2, wherein the charge transport material is an aminobiphenyl compound having the following formula (6):

(6)

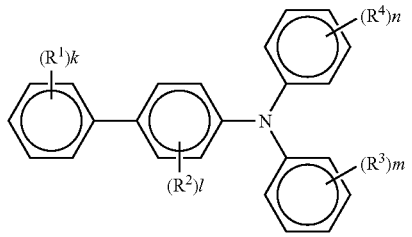

wherein each of $R^1$, $R^3$, and $R^4$ independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aryl group; $R^2$ represents a hydrogen atom, an alkoxy group, a substituted or unsubstituted alkyl group, or a halogen atom; each of k, l, m, and n independently represents an integer of from 1 to 4; and when each of k, l, m, and n is an integer of from 2 to 4, multiple $R^1$, $R^2$, $R^3$, and $R^4$ may be, but need not necessarily be, the same.

5. The electrophotographic photoreceptor according to claim 2, wherein the charge transport material is a diolefin compound having the following formula (29):

$$A\text{-}CH{=}CH{-}Ar{-}CH{=}CH\text{-}A \quad (29)$$

wherein Ar represents a substituted or unsubstituted aromatic hydrocarbon group; and A represents a group having the following formula (30):

(30)

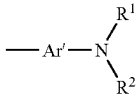

wherein Ar' represents a substituted or unsubstituted divalent aromatic hydrocarbon group; and each of $R^1$ and $R^2$ independently represents a substituted or unsubstituted alkyl group or a substituted or unsubstituted aryl group.

6. The electrophotographic photoreceptor according to claim 2, wherein the charge transport material is a charge transport polymer.

7. The electrophotographic photoreceptor according to claim 6, wherein the charge transport polymer is a compound having the following formula (7):

(7)

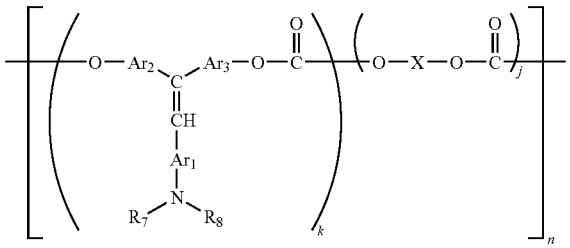

wherein each of $R_7$ and $R_8$ independently represents a substituted or unsubstituted monovalent aromatic group; each of $Ar_1$, $Ar_2$, and $Ar_3$ independently represents a divalent aromatic group; k represents a numeral of from 0.1 to 1; j represents a numeral of from 0 to 0.9; n represents an integer of from 5 to 5,000; and X represents an aliphatic divalent group, an alicyclic divalent group, or a divalent group having the following formula (8):

(8)

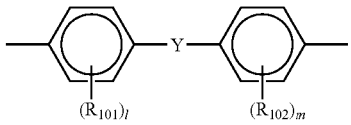

wherein each of $R_{101}$ and $R_{102}$ independently represents a substituted or unsubstituted alkyl group, an aromatic group, or a halogen atom; each of l and m independently represents an integer of from 0 to 4; Y represents a single bond, a straight-chain, branched-chain, or cyclic alkylene group having 1 to 12 carbon atoms, —O—, —S—, —SO—, —$SO_2$—, —CO—, (Z represents an aliphatic divalent group), or a group having the following formula (9):

(9)

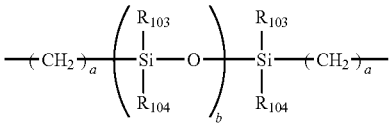

wherein a represents an integer of from 1 to 20; b represents an integer of from 1 to 2,000; and each of $R_{103}$ and $R_{104}$ independently represents a substituted or unsubstituted alkyl group or an aryl group.

8. The electrophotographic photoreceptor according to claim 6, wherein the charge transport polymer is a compound having the following formula (10):

(10)

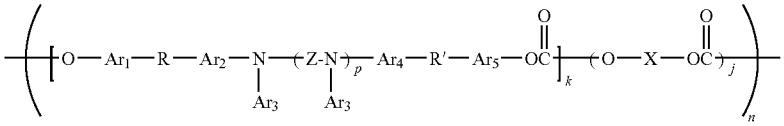

wherein each of $Ar_1$, $Ar_2$, $Ar_4$ and $Ar_5$ independently represents a substituted or unsubstituted divalent aromatic group; $Ar_3$ represents a substituted or unsubstituted monovalent aromatic group; Z represents a divalent aromatic group or —$Ar_6$-Za-$Ar_6$— ($Ar_6$ represents a substituted or unsubstituted divalent aromatic group and Za represents O, S, or an alkylene group); each of R and R' independently represents a straight-chain or branched-chain alkylene group; p represents an integer of 0 or 1; k represents a numeral of from 0.1 to 1; j represents a numeral of from 0 to 0.9; n represents an integer of from 5 to 5,000; and X represents an aliphatic divalent group, an alicyclic divalent group, or a divalent group having the following formula (8):

(8)

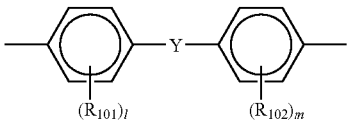

wherein each of $R_{101}$ and $R_{102}$ independently represents a substituted or unsubstituted alkyl group, an aromatic group, or a halogen atom; each of l and m independently represents an integer of from 0 to 4; Y represents a single bond, a straight-chain, branched-chain, or cyclic alkylene group having 1 to 12 carbon atoms, —O—, —S—, —SO—, —$SO_2$—, —CO—, (Z represents an aliphatic divalent group), or a group having the following formula (9):

(9)

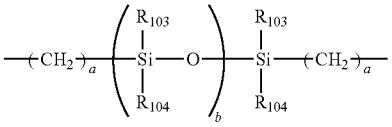

wherein a represents an integer of from 1 to 20; b represents an integer of from 1 to 2,000; and each of $R_{103}$ and $R_{104}$ independently represents a substituted or unsubstituted alkyl group or an aryl group.

9. The electrophotographic photoreceptor according to claim 1, wherein the photosensitive layer further comprises a charge transport material and a charge generation material.

10. The electrophotographic photoreceptor according to claim 1, wherein the photosensitive layer is a multilayer which comprises:

a charge generation layer comprising a charge generation material; and a charge transport layer comprising a charge transport material.

11. The electrophotographic photoreceptor according to claim 1, wherein the photosensitive layer is a single layer which comprises a charge transport material and a charge generation material.

12. An image forming method, comprising:

charging the electrophotographic photoreceptor according to claim 1;

irradiating the charged electrophotographic photoreceptor with a light beam to form an electrostatic latent image thereon;

developing the electrostatic latent image with a toner to form a toner image; and transferring the toner image onto a recording medium.

13. The image forming method according to claim 12, wherein the light beam is emitted from a light-emitting device including a laser diode, a light-emitting diode, or an electroluminescence as a light source.

14. An image forming apparatus, comprising:

the electrophotographic photoreceptor according to claim 1 configured to bear an electrostatic latent image;

a charger configured to charge the electrophotographic photoreceptor;

an irradiator configured to irradiate the charged electrophotographic photoreceptor with a light beam to form an electrostatic latent image thereon;

a developing device configured to develop the electrostatic latent image with a toner to form a toner image; and a transfer device configured to transfer the toner image onto a recording medium.

15. The image forming apparatus according to claim 14, wherein the light beam is emitted from a light-emitting device including a laser diode, a light-emitting diode, or an electroluminescence as a light source.

16. A process cartridge detachably attachable to image forming apparatuses, comprising:

the electrophotographic photoreceptor according to claim 1 configured to bear an electrostatic latent image; and at least one of a charger for charging the electrophotographic photoreceptor, an irradiator for irradiating the electrophotographic photoreceptor with a light beam, a developing device for developing an electrostatic latent image formed on the electrophotographic photoreceptor with a toner to form a toner image, a transfer device for transferring a toner image from the electrophotographic photoreceptor onto a recording medium, a cleaning device for removing residual toner particles from the electrophotographic photoreceptor, and a decharging device for decharging the electrophotographic photoreceptor.

* * * * *